US006587038B2

(12) United States Patent
Cheng et al.

(10) Patent No.: US 6,587,038 B2
(45) Date of Patent: Jul. 1, 2003

(54) ALARM GENERATION USING A MOTOR

(75) Inventors: Peter L. Cheng, Irvine, CA (US); Akihiko Hamamoto, Irvine, CA (US); Takao Aichi, Irvine, CA (US)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/886,089

(22) Filed: Jun. 22, 2001

(65) Prior Publication Data

US 2002/0196130 A1 Dec. 26, 2002

(51) Int. Cl.[7] ..... G08B 3/00
(52) U.S. Cl. ..... 340/384.1; 318/35
(58) Field of Search ..... 340/384.1, 398.1, 340/404.2; 368/259, 260; 318/35, 54

(56) References Cited

U.S. PATENT DOCUMENTS 4,480,541 A * 11/1984 Grummett ..... 101/93.04
4,582,438 A * 4/1986 Okabayashi et al. ..... 318/565
4,898,059 A * 2/1990 Iizuka ..... 340/384.5
5,077,680 A * 12/1991 Sturm et al. ..... 358/1.5

* cited by examiner

*Primary Examiner*—John Tweel
(74) *Attorney, Agent, or Firm*—Fitzpatrick, Cella, Harper & Scinto

(57) ABSTRACT

A system and method for generating an audible sound in an imaging device is provided, the device having an electronic motor controllable by a first operation sequence to perform a first function. When a condition is detected for which an audible sound is to be generated as notification of the condition, a motor is rotated according to a second operation sequence so as to create the audible sound as notification of the condition, wherein the second operation sequence causes the motor to rotate in a manner, other than the motor rotation resulting from the first operation sequence, so as to cause the motor to perform only the notification function.

16 Claims, 18 Drawing Sheets

1201

| MOTOR STEP | TIME | POSITION | DIRECTION |
|---|---|---|---|
| 1 | 0 | AB=11 | – |
| 2 | 1 | AB=01 | CW |
| 3 | 2 | AB=00 | CW |
| 4 | 3 | AB=10 | CW |
| 5 | 4 | AB=11 | CW |
| 6 | 5 | AB=10 | CCW |
| 7 | 6 | AB=00 | CCW |
| 8 | 7 | AB=01 | CCW |
| 9 | 8 | AB=11 | CCW |
| 10 | 9 | AB=01 | CW |
| 11 | 10 | AB=00 | CW |
| 12 | 11 | AB=01 | CW |
| 13 | 12 | AB=11 | CW |

1202

| MOTOR STEP | TIME | POSITION | DIRECTION |
|---|---|---|---|
| 1 | 0 | AB=11 | – |
| 2 | 1 | AB=01 | CW |
| 3 | 2 | AB=00 | CW |
| 4 | 3 | AB=10 | CW |
| 5 | 4 | AB=11 | CW |
| 6 | 5 | AB=10 | CCW |
| 7 | 6 | AB=00 | CCW |
| 8 | 7 | AB=01 | CCW |
| 9 | 8 | AB=11 | CCW |
| 10 | 9 | AB=01 | – |
| 11 | 10 | AB=00 | – |

FIG. 12D

| on_time CONTROL BLOCK | CONTENTS |
|---|---|
| NUMBER OF STEPS | on_step_count |
| MOTOR STEP 1 | AB=11 |
| MOTOR STEP 2 | AB=01 |
| MOTOR STEP 3 | AB=00 |
| MOTOR STEP 4 | AB=10 |
| MOTOR STEP 5 | AB=11 |
| MOTOR STEP 6 | AB=10 |
| MOTOR STEP 7 | AB=00 |
| MOTOR STEP 8 | AB=01 |
| TIME PER STEP | on_step_time |

| off_time CONTROL BLOCK | CONTENTS |
|---|---|
| NUMBER OF STEPS | off_step_count |
| MOTOR STEP 1 | AB=11 |
| TIME PER STEP | off_step_time |

| STOP CONTROL BLOCK | CONTENTS |
|---|---|
| NUMBER OF STEPS | 0 |

FIG. 12E

MOTOR DRIVER IC CONTROL WORD

| PHASE A | $IA_3$ | $IA_2$ | $IA_1$ | $IA_0$ | DECAY $A_1$ | DECAY $A_0$ | PHASE B | $IB_3$ | $IB_2$ | $IB_1$ | $IB_0$ | DECAY $B_1$ | DECAY $B_0$ | $T_1$ | $T_0$ |
|---|---|---|---|---|---|---|---|---|---|---|---|---|---|---|---|

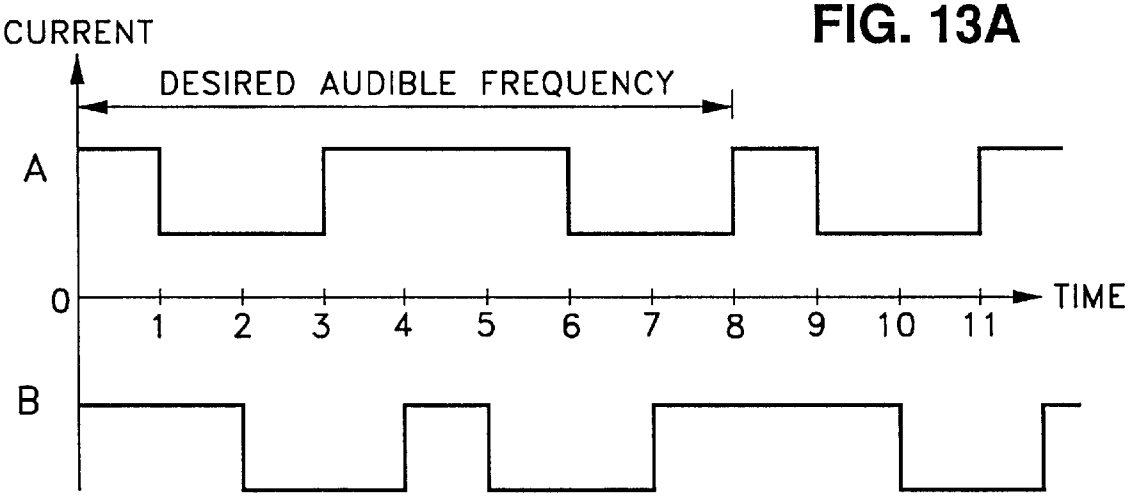
FIG. 13A
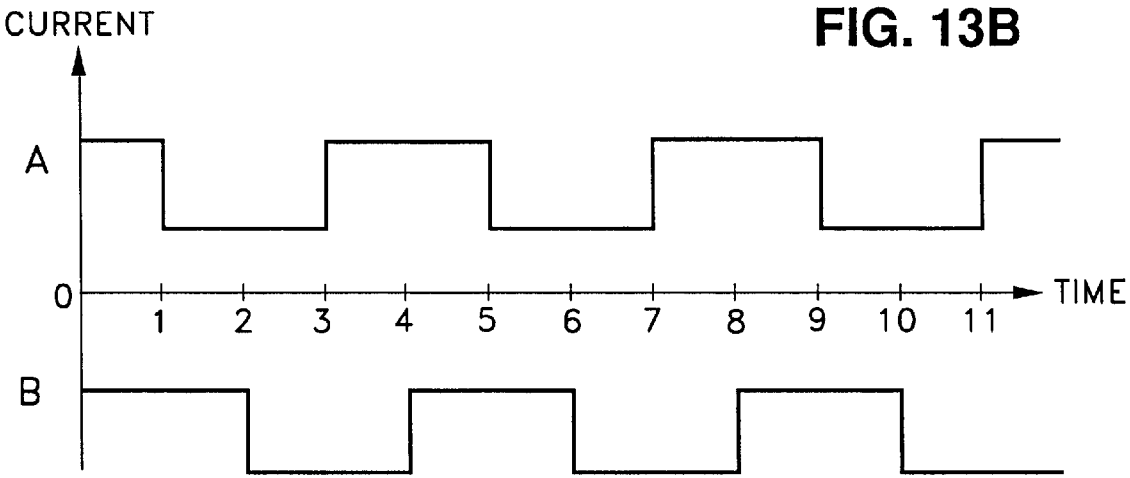
FIG. 13B
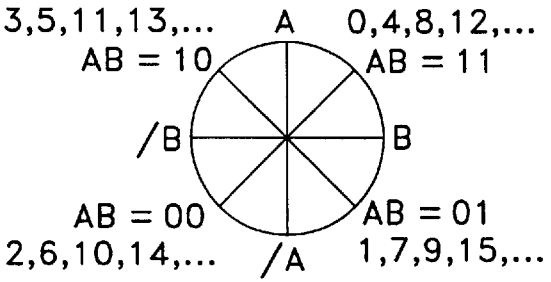

| CONDITION | TON (msec) | TOFF (msec) | DAF | RC | VOL |
|---|---|---|---|---|---|
| UserResponse | | | | | |
| FactoryHardPowerOn | 100 | 0 | 1046 HZ | 1 | 100% |
| InitializeEEPROM | 100 | 0 | 1046 HZ | 1 | 100% |
| ClearService | 100 | 0 | 1046 HZ | 1 | 100% |
| ClearWasteInk | 100 | 0 | 1046 HZ | 1 | 100% |
| ServiceSelect | 100 | 0 | 1046 HZ | 1 | 100% |
| ServiceFunctionSelect | 100 | 0 | 1046 HZ | 1 | 100% |
| ServiceExit | 100 | 0 | 1046 HZ | 1 | 100% |
| FactorySelect | 100 | 0 | 1046 HZ | 1 | 100% |
| FactoryFunctionSelect | 100 | 0 | 1046 HZ | 1 | 100% |
| ResponseBeep | 100 | 0 | 1046 HZ | 1 | 100% |
| BeepSound | 100 | 0 | 1046 HZ | 1 | 100% |
| ERRORS | | | | | |
| HeadChangeError | 50 | 20 | 1244 HZ | 5 | 100% |
| FatalError | 50 | 20 | 1244 HZ | 7 | 100% |
| EnginePowerOnError | 50 | 20 | 1244 HZ | 2 | 100% |
| PaperEmpty | 50 | 20 | 1244 HZ | 2 | 100% |
| PaperJam | 50 | 20 | 1244 HZ | 2 | 100% |
| WasteInkError | 50 | 20 | 1244 HZ | 6 | 100% |
| AHeadError | 50 | 20 | 1244 HZ | 4 | 100% |
| BHeadError | 50 | 20 | 1244 HZ | 3 | 100% |
| ServiceCancel | 50 | 20 | 1244 HZ | 2 | 100% |
| FactoryCancel | 50 | 20 | 1244 HZ | 2 | 100% |
| ErrorSound | 50 | 20 | 1244 HZ | 4 | 100% |

FIG. 14

ALARM GENERATION USING A MOTOR

BACKGROUND OF THE INVENTION

1. Field of the Invention

The invention relates to generation of an audible sound by a motor of a device. More specifically, the present invention concerns generating one or more audible sounds using a motor in the device, such an audible sound is made during operations of the motor other than regular motor operations, and may be used as notification of a condition such as a device malfunction or error, an operation completion condition as well as other conditions or events.

2. Description of the Related Art

Currently, there are numerous devices that use a dedicated component that emits an audible sound to notify users of the occurrence of a specified event. For example, a device such as an ink jet printer uses a buzzer component whose function is to produce a beep upon activation of a print head cleaning function, or provide a variety of consecutive beeping sounds indicating different types of errors, such as paper empty, paper jam, etc. The component that is used to generate the audible sound is a piezoelectric alarm or buzzer. These alarms or buzzers are separate components that are integrated into the device's printed circuit board. Some require specifically designed driving circuits. The addition of a separate component and in some instances, a specifically designed driving circuit, adds to the cost of the device. In addition, it is possible that a buzzer component may itself malfunction. In such a case, there is no mechanism to be able to provide notification using such a component. For at least these reasons, it would be beneficial to have the ability to generate an audible sound within a device using a component of the device that traditionally serves an other function to provide the notification. In so doing, it is possible to eliminate the need to, and/or to provide redundancy with respect for, additional components whose sole purpose is to provide such notification.

SUMMARY OF THE INVENTION

The present invention addresses the foregoing and concerns a device having at least one motor, the at least one motor is used to generate an audible sound as notification of an occurrence of a condition. The at least one motor preferably, although not necessarily, providing a function in addition to the notification function. The notification function served by the at least one motor may be a primary source of such notification or such function may be provided as a backup for a primary notification source. For example, in the latter case, the motor's notification function may be used should dedicated alarm component malfunction.

Advantageously, where operation of a motor according to the present invention serves as the only source of a notification function, the present invention provides at least the opportunity of reducing the complexity of the device by eliminating the need for other components whose sole function is a notification function. In so doing, it is possible to reduce the cost and complexity of the device hardware. Where the present invention is used as a backup for a notification component, notification may be made even in a case where another source for notification (e.g., a piezoelectric buzzer or speaker) is malfunctioning.

Accordingly, the invention is directed to method and apparatus for controlling a motor within a device to generate an audible sound used to indicate the occurrence of a condition.

According to an embodiment of the invention, a method is provided for generating an audible sound in an imaging device, the device having an electronic motor controllable by a first operation sequence to perform a first function, the method comprising the steps of detecting a condition for which an audible sound is to be generated as notification of the condition, and causing the motor to rotate according to a second operation sequence so as to create the audible sound as notification of the condition, wherein the second operation sequence causes the motor to rotate in a manner, other than the motor rotation resulting from the first operation sequence, so as to cause the motor to perform only the notification function.

This brief summary has been provided so that the nature of the invention may be understood quickly. A more complete understanding of the invention can be obtained by reference to the following detailed description of the preferred embodiment(s) thereof in connection with the attached drawings.

BRIEF DESCRIPTION OF THE DRAWINGS

FIG. 12D are the motor control blocks used to set the motor driver IC control word according to the present invention.

FIG. 12E is a drawing depicting the motor drive IC control word according to the present invention.

FIG. 13A is a drawing illustrating motor control during sound generation according to the present invention.

FIG. 13B is a drawing illustrating motor control during normal motor usage according to the present invention.

FIG. 14 is a list of the present invention's conditions requiring generation of a sound and their respective variable values according to the present invention.

DETAILED DESCRIPTION OF THE PREFERRED EMBODIMENTS

As described above, the invention is directed to controlling a motor within a device to generate an audible sound used to indicate the occurrence of a condition. In preferred embodiments of the invention, the device is an ink jet printer. However, it should be understood that even though the invention is described with reference to an ink jet printer, the invention could be practiced in any number of other devices including, by way of example and without limitation to, other types of printers as well as facsimile machines and copiers.

Figure 1:
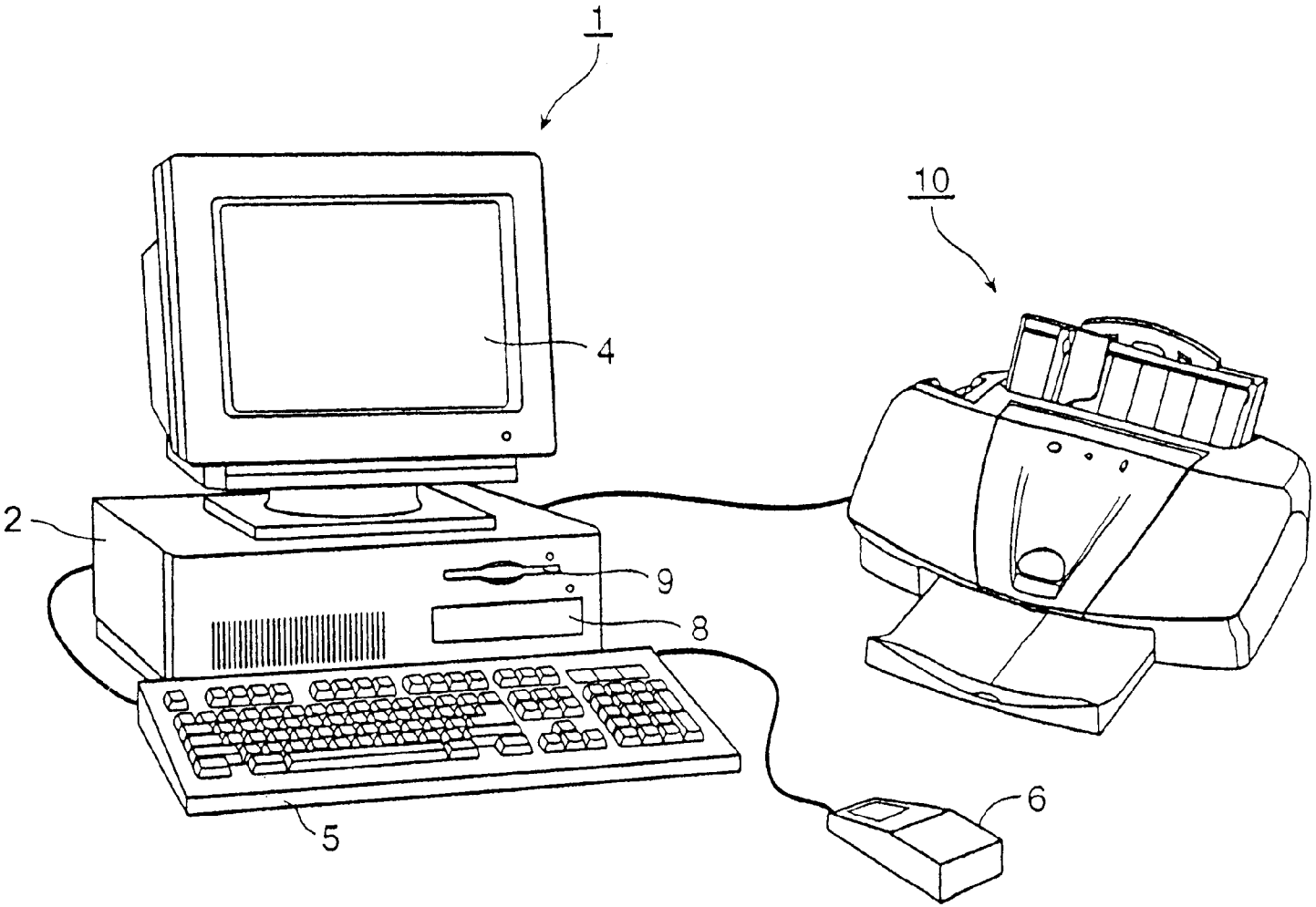
FIG. 1 shows a perspective view of computing equipment used in connection with the printer of the present invention.

FIG. 1 is a view showing an outward appearance of computing equipment used in connection with the invention described herein. Computing equipment 1 includes host processor 2. Host processor 2 comprises a personal computer (hereinafter "PC"), preferably an IBM PC-compatible computer having a windowing environment, such as Microsoft® Windows95. Provided with computing equipment 1 is display 4 comprising a color monitor or the like, keyboard 5 for entering text data and user commands, and pointing device 6. Pointing device 6 preferably comprises a mouse for pointing and for manipulating objects displayed on display 4.

Computing equipment 1 includes a computer-readable memory medium, such as fixed disk 8, and floppy disk drive 9. Fixed disk 8 and floppy disk drive 9 provide means whereby computing equipment 1 can access information, such as data, application programs, etc. stored on fixed disk 8 or stored on one or more floppy disks readable by floppy disk drive 9. A similar CD-ROM interface (not shown) may be provided with computing equipment 1, through which computing equipment 1 can access information stored on CD-ROMs.

Application programs, such as those stored on fixed disk 8, provide a mechanism by which host processor 2 generates files, manipulates and stores those files on disk 8, presents data in those files to an operator via display 4, and prints data in those files via printer 10. Disk 8 also stores an operating system, which, as noted above, is preferably a windowing operating system such as Windows95. Device drivers are also stored in disk 8. At least one of the device drivers comprises a printer driver that provides a software interface to firmware in printer 10. Data exchange between host processor 2 and printer 10 is described in more detail below.

Figure 2:
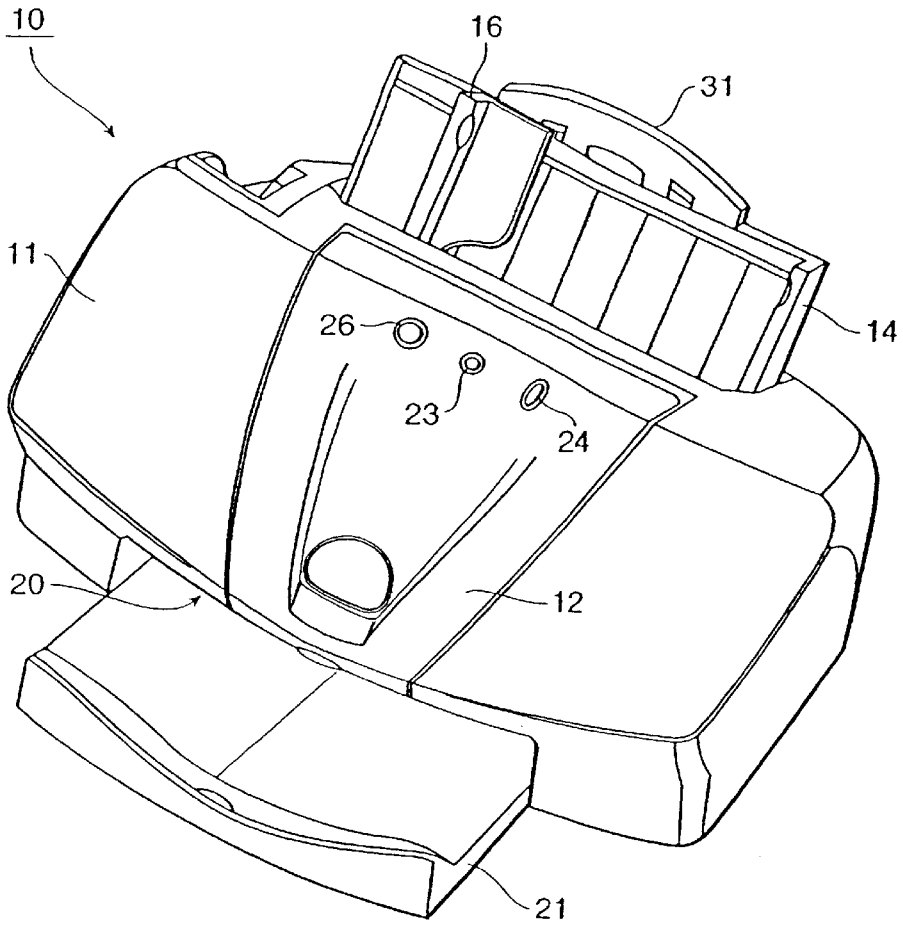
FIG. 2 is a front perspective view of the printer shown in FIG. 1.
Figure 3:
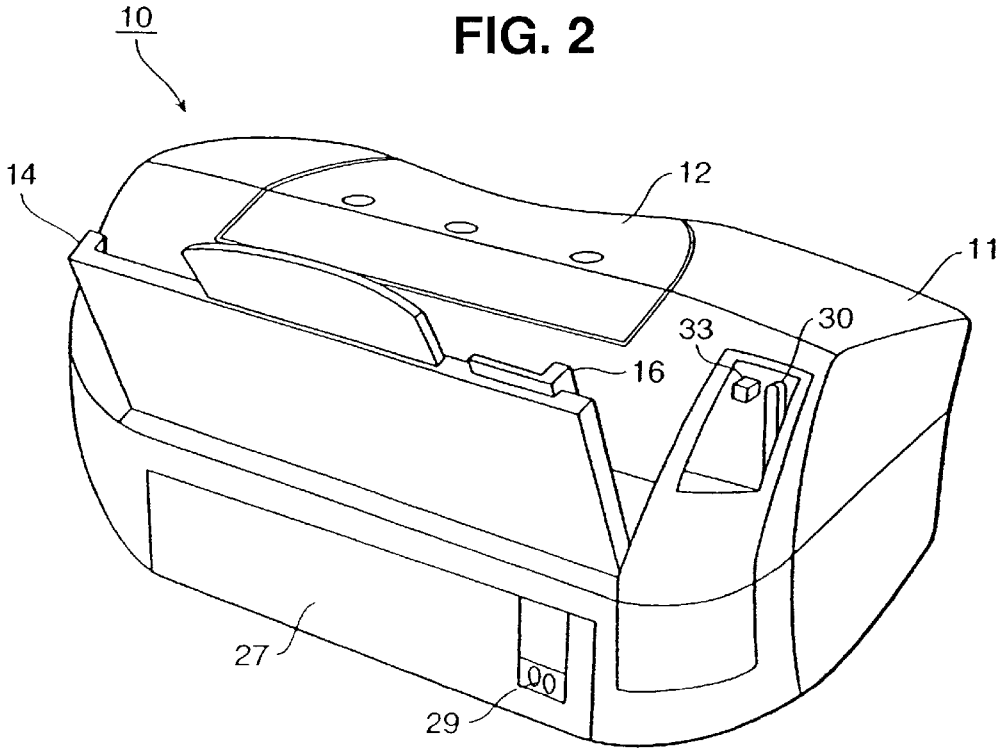
FIG. 3 is a back perspective view of the printer shown in FIG. 1.

FIGS. 2 and 3 show perspective front and back views, respectively, of printer 10. As shown in FIGS. 2 and 3, printer 10 includes housing 11, access door 12, automatic feeder 14, automatic feed adjuster 16, media eject port 20, ejection tray 21, power source 27, power cord connector 29, parallel port connector 30 and universal serial bus (USB) connector 33.

Figure 4:
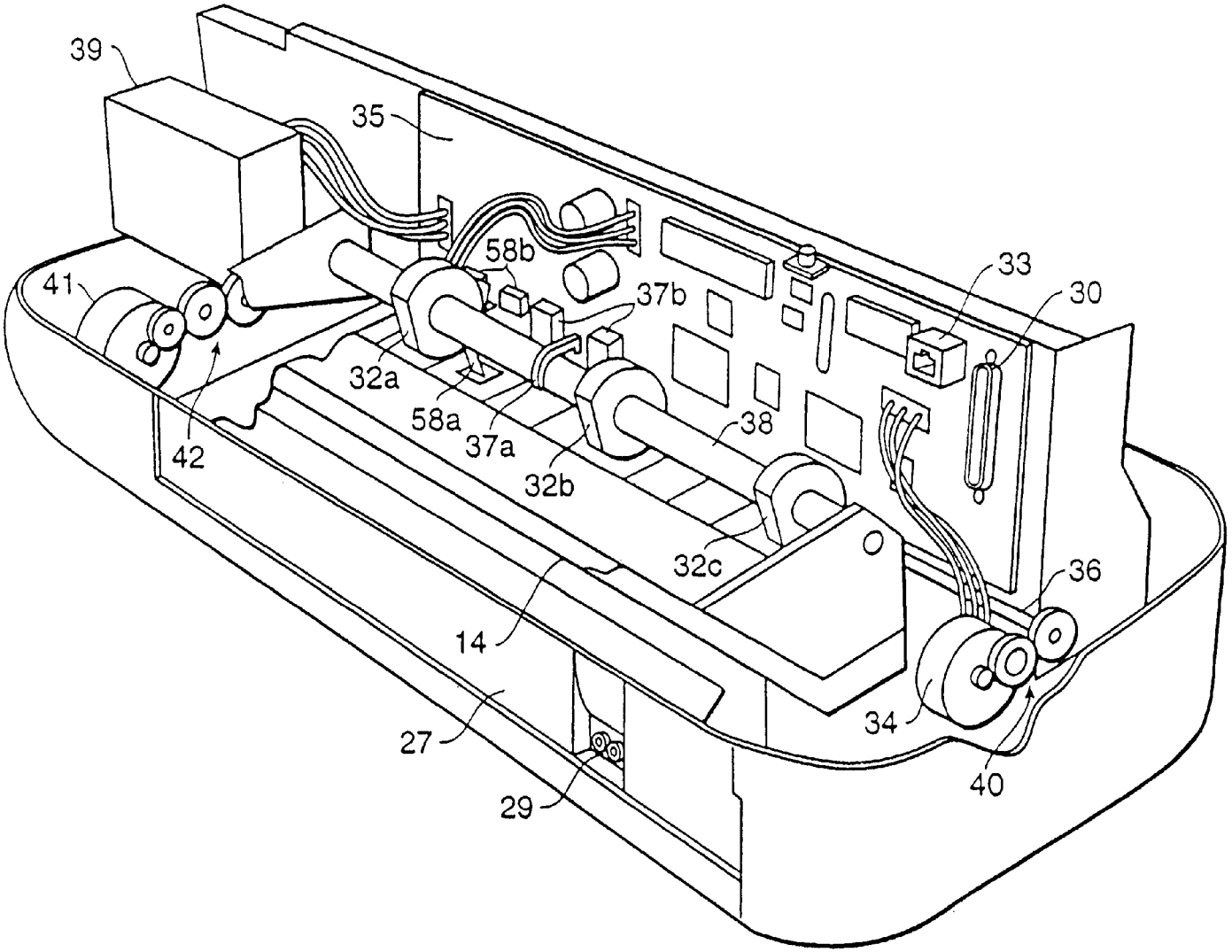
FIG. 4 is a back cut-away perspective view of the printer shown in FIG. 1.
Figure 5:
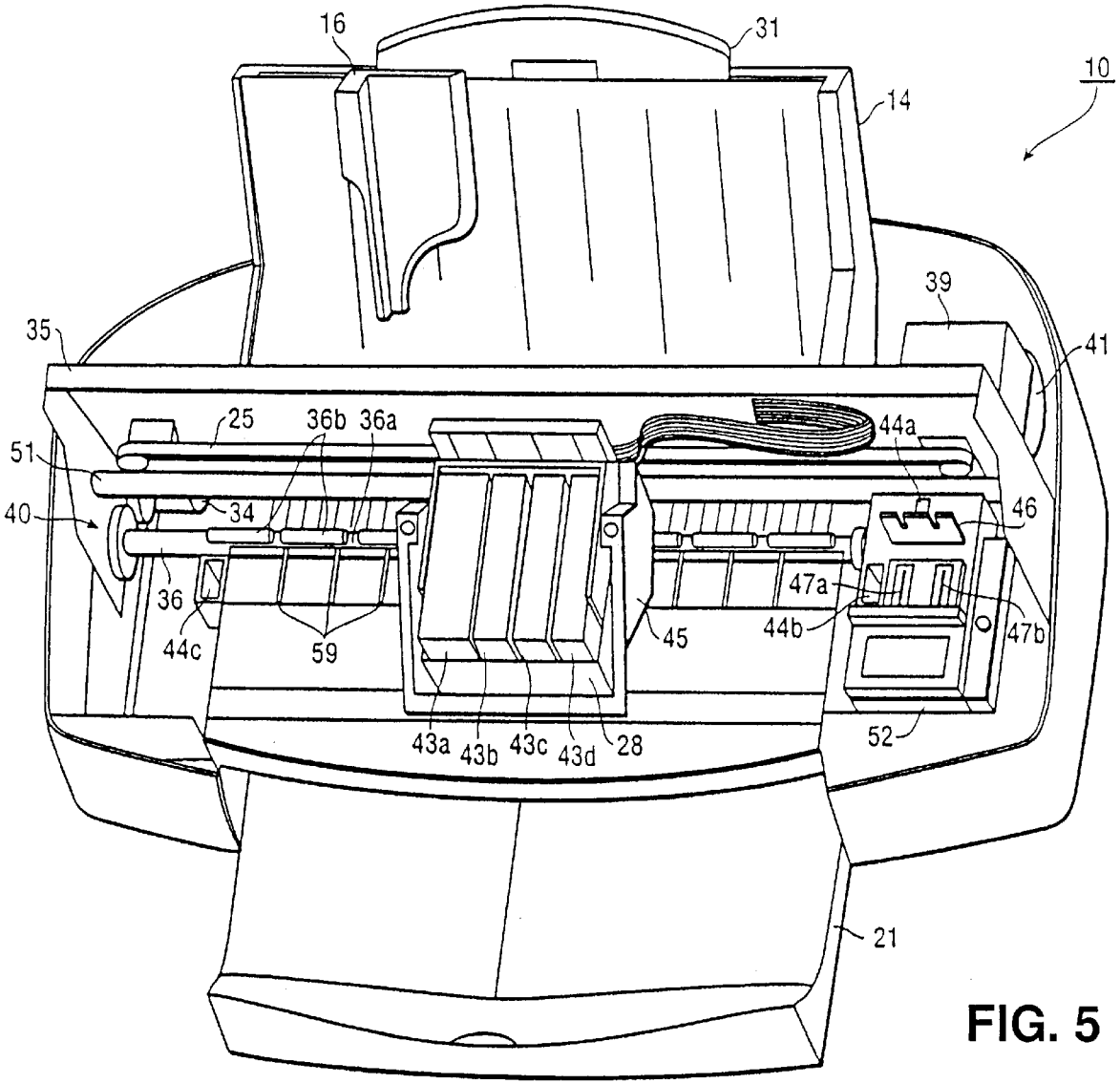
FIG. 5 is front cut-away perspective view of the printer shown in FIG. 1.

FIGS. 4 and 5 show back and front cut-away perspective views, respectively, of printer 10. In FIG. 4, printer 10 includes line feed motor 34 that is utilized for feeding the recording medium through printer 10 during printing operations, where line feed motor 34 drives line feed shaft 36. In FIG. 5, line feed motor 34 drives line feed shaft 36, which includes line feed pinch rollers 36*a,* via line feed gear train 40. The gear train ratio for line feed gear train 40 is set to advance the recording medium a set amount for each pulse of line feed motor 34. The ratio may be set so that one pulse of line feed motor 34 results in a line feed amount of the recording medium equal to a one-pixel resolution advancement of the recording medium. That is, if one pixel resolution of the printout of printer 10 is 600 dpi (dots per inch), the gear train ratio may be set so that one pulse of line feed motor 34 results in a 600 dpi advancement of the recording medium. Alternatively, the ratio may be set so that each pulse of the motor results in a line feed amount that is equal to a fractional portion of one pixel resolution rather than being a one-to-one ratio. Line feed motor 34 preferably comprises a 200-step, 2 phase pulse motor and is controlled in response to signal commands received from circuit board 35. Of course, line feed motor 34 is not limited to a 200-step 2 phase pulse motor and any other type of line feed motor could be employed, including, but not limited to, a DC motor with an encoder.

Figure 6:
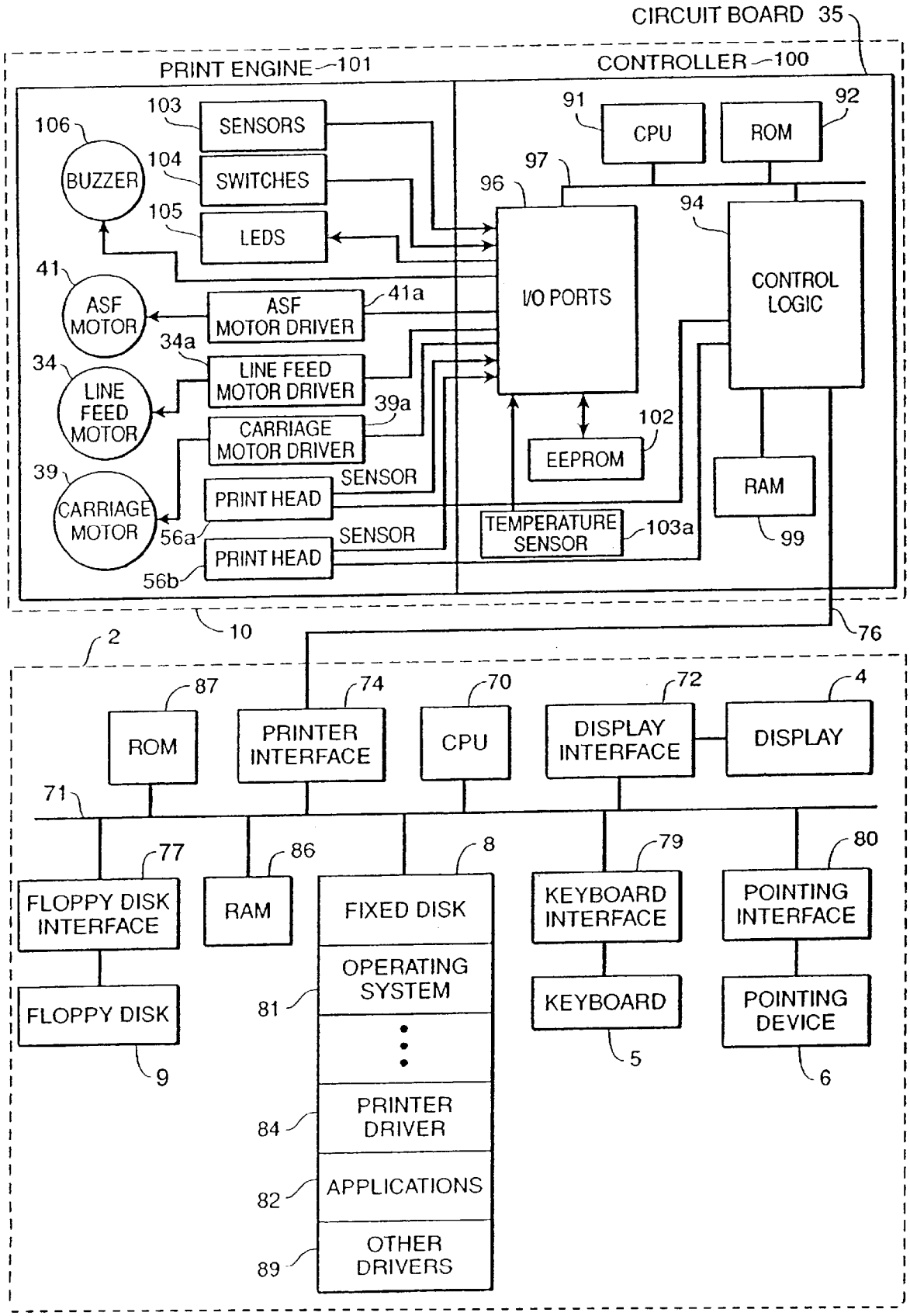
FIG. 6 is a block diagram showing the hardware configuration of a host processor interfaced to the printer shown in FIG. 1.

FIG. 6 is a block diagram showing the internal structures of host processor 2 and printer 10. In FIG. 6, host processor 2 includes a central processing unit 70 such as a programmable microprocessor interfaced to computer bus 71. Also coupled to computer bus 71 are display interface 72 for interfacing to display 4, printer interface 74 for interfacing to printer 10 through bi-directional communication line 76, floppy disk interface 77 for interfacing to floppy disk drive 9, keyboard interface 79 for interfacing to keyboard 5, and pointing device interface 80 for interfacing to pointing device 6. Disk 8 includes an operating system section for storing operating system 81, an applications section for storing applications 82, and a printer driver section for storing printer driver 84.

A random access main memory (hereinafter "RAM") 86 interfaces to computer bus 71 to provide CPU 70 with access to memory storage. In particular, when executing stored application program instruction sequences such as those associated with application programs stored in applications section 82 of disk 8, CPU 70 loads those application instruction sequences from disk 8 (or other storage media such as media accessed via a network or floppy disk interface 77) into random access memory (hereinafter "RAM") 86 and executes those stored program instruction sequences out of RAM 86. RAM 86 provides for a print data buffer used by printer driver 84. It should also be recognized that standard disk-swapping techniques available under the windowing operating system allow segments of memory, including the aforementioned print data buffer, to be swapped on and off of disk 8. Read only memory (hereinafter "ROM") 87 in host processor 2 stores invariant instruction sequences, such as start-up instruction sequences or basic input/output operating system (BIOS) sequences for operation of keyboard 5.

As shown in FIG. 6, and as previously mentioned, disk 8 stores program instruction sequences for a windowing operating system and for various application programs such as graphics application programs, drawing application programs, desktop publishing application programs, and the like. In addition, disk 8 also stores color image files such as might be displayed by display 4 or printed by printer 10 under control of a designated application program. Disk 8 also stores a color monitor driver in other drivers section 89 which controls how multi-level RGB color primary values are provided to display interface 72. Printer driver 84 controls printer 10 for both black and color printing and supplies print data for print out according to the configuration of printer 10. Print data is transferred to printer 10, and control signals are exchanged between host processor 2 and printer 10, through printer interface 74 connected to line 76 under control of printer driver 84. Printer interface 74 and line 76 may be, for example an IEEE 1284 parallel port and cable or a universal serial bus port and cable. Other device drivers are also stored on disk 8, for providing appropriate signals to various devices, such as network devices, facsimile devices, and the like, connected to host processor 2.

Ordinarily, application programs and drivers stored on disk 8 first need to be installed by the user onto disk 8 from other computer-readable media on which those programs and drivers are initially stored. For example, it is customary for a user to purchase a floppy disk, or other computer-readable media such as CD-ROM, on which a copy of a printer driver is stored. The user would then install the printer driver onto disk 8 through well-known techniques by which the printer driver is copied onto disk 8. At the same time, it is also possible for the user, via a modem interface (not shown) or via a network (not shown), to download a printer driver, such as by downloading from a file server or from a computerized bulletin board.

Referring again to FIG. 6, printer 10 includes a circuit board 35 which essentially contains two sections, controller 100 and print engine 101. Controller 100 includes CPU 91 such as an 8-bit or a 16-bit microprocessor including programmable timer and interrupt controller, ROM 92, control logic 94, and I/O ports unit 96 connected to bus 97. Also connected to control logic 94 is RAM 99. Control logic 94 includes controllers for line feed motor 34, for print image buffer storage in RAM 99, for heat pulse generation, and for head data. Control logic 94 also provides control signals for nozzles in print heads 56*a* and 56*b* of print engine 101, carriage motor 39, ASF motor 41, line feed motor 34, and print data for print heads 56*a* and 56*b*. EEPROM 102 is connected to I/O ports unit 96 to provide non-volatile memory for printer information and also stores parameters that identify the printer, the driver, the print heads, the status of ink in the cartridges, etc., which are sent to printer driver 84 of host processor 2 to inform host processor 2 of the operational parameters of printer 10.

Sensors, generally indicated as 103, are arranged in print engine 101 to detect printer status and to measure temperature and other quantities that affect printing. For example, a temperature sensor (e.g., a low precision thermistor) may be used to measure ambient environmental temperature and a photo sensor (e.g., an automatic alignment sensor) measures print density and dot locations for automatic alignment. Sensors 103 are also arranged in print engine 101 to detect other conditions such as the open or closed status of access door 12, presence of recording media, etc. In addition, diode sensors, including a thermistor, are located in print heads 56*a* and 56*b* to measure print head temperature, which is transmitted to I/O ports unit 96.

I/O ports unit 96 also receives input from switches 104 such as power button 24 and resume button 26 and delivers control signals to LEDs 105 to light indicator 23, optionally to buzzer 106, and to line feed motor 34 and carriage motor 39 through line feed motor driver 34*a* and carriage motor driver 39*a,* respectively.

Although buzzer 106 is illustrated in FIG. 6, as previously described, the present invention may be used in place of or in combination with a notification mechanism such as buzzer 106. Buzzer 106 may be a piezoelectric buzzer or speaker, for example. Notification of various conditions may be provided using the present invention either alone or in combination with buzzer 106.

As an example of such a condition that may have a corresponding notification, resume button 26 provides control by which an operator can resume printing after an error condition has occurred. In addition, resume button 26 can be used to activate other functions. To illustrate, a print head cleaning function can be activated by holding down resume button 26 until a notification (e.g., a single beep) is produced. Notification may also be provided for recoverable errors such as paper empty, paper jam, defective cartridge installed in printer 10, cartridge replacement in process, etc. Similarly, it is possible to distinguish or bring to one's attention a fatal error such as one requiring a service call. As in traditional sound generation, it is possible to distinguish between types of errors based on the audible sound generated using the present invention. The audible sound may be a series of "beeps" or one continuous "beep". In addition, a volume may be used to differentiate between audible sounds.

I/O ports unit 96 is coupled to print engine 101 in which the pair of print heads 56*a* and 56*b* perform recording on a recording medium by scanning across the recording medium while printing using print data from a print buffer in RAM 99. Control logic 94 is also coupled to printer interface 74 of host processor 2 via communication line 76 for exchange of control signals and to receive print data and print data addresses. ROM 92 stores font data, program instruction sequences used to control printer 10, and other invariant data for printer operation. RAM 99 stores print data in a print buffer defined by printer driver 84 for print heads 56*a* and 56*b* and other information for printer operation.

Although FIG. 6 shows individual components of printer 10 as separate and distinct from one another, it is preferable that some of the components be combined. For example, control logic 94 may be combined with I/O ports 96 in an ASIC to simplify interconnections for the functions of printer 10.

Figure 7:
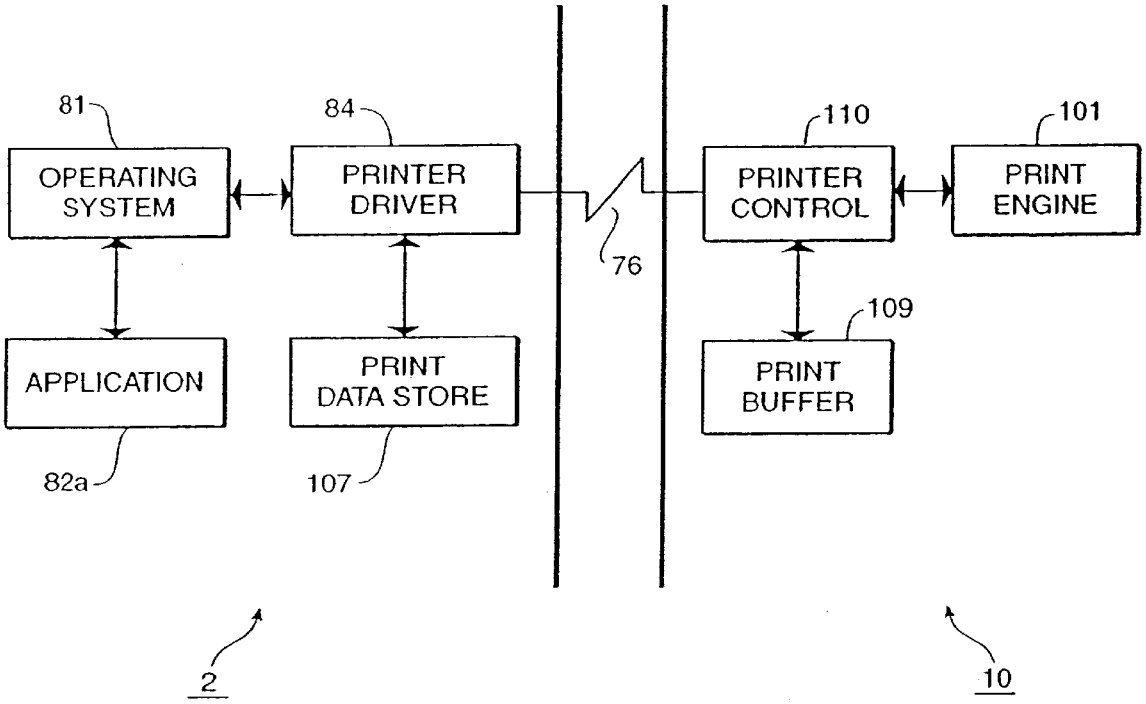
FIG. 7 shows a functional block diagram of the host processor and printer shown in FIG. 6.

FIG. 7 shows a high-level functional block diagram that illustrates the interaction between host processor 2 and printer 10. As illustrated in FIG. 7, when a print instruction is issued from image processing application program 82*a* stored in application section 82 of disk 8, operating system 81 issues graphics device interface calls to printer driver 84. Printer driver 84 responds by generating print data corresponding to the print instruction and stores the print data in print data store 107. Print data store 107 may reside in RAM 86 or in disk 8, or through disk swapping operations of operating system 81 may initially be stored in RAM 86 and swapped in and out of disk 8. Thereafter, printer driver 84 obtains print data from print data store 107 and transmits the print data through printer interface 74, to bi-directional communication line 76, and to print buffer 109 through printer control 110. Print buffer 109 resides in RAM 99, and printer control 110 resides in firmware implemented through control logic 94 and CPU 91 of FIG. 6. Printer control 110 processes the print data in print buffer 109 responsive to commands received from host processor 2 and performs printing tasks under control of instructions stored in ROM 92 (see FIG. 6) to provide appropriate print head and other control signals to print engine 101 for recording images onto recording media.

Figure 8:
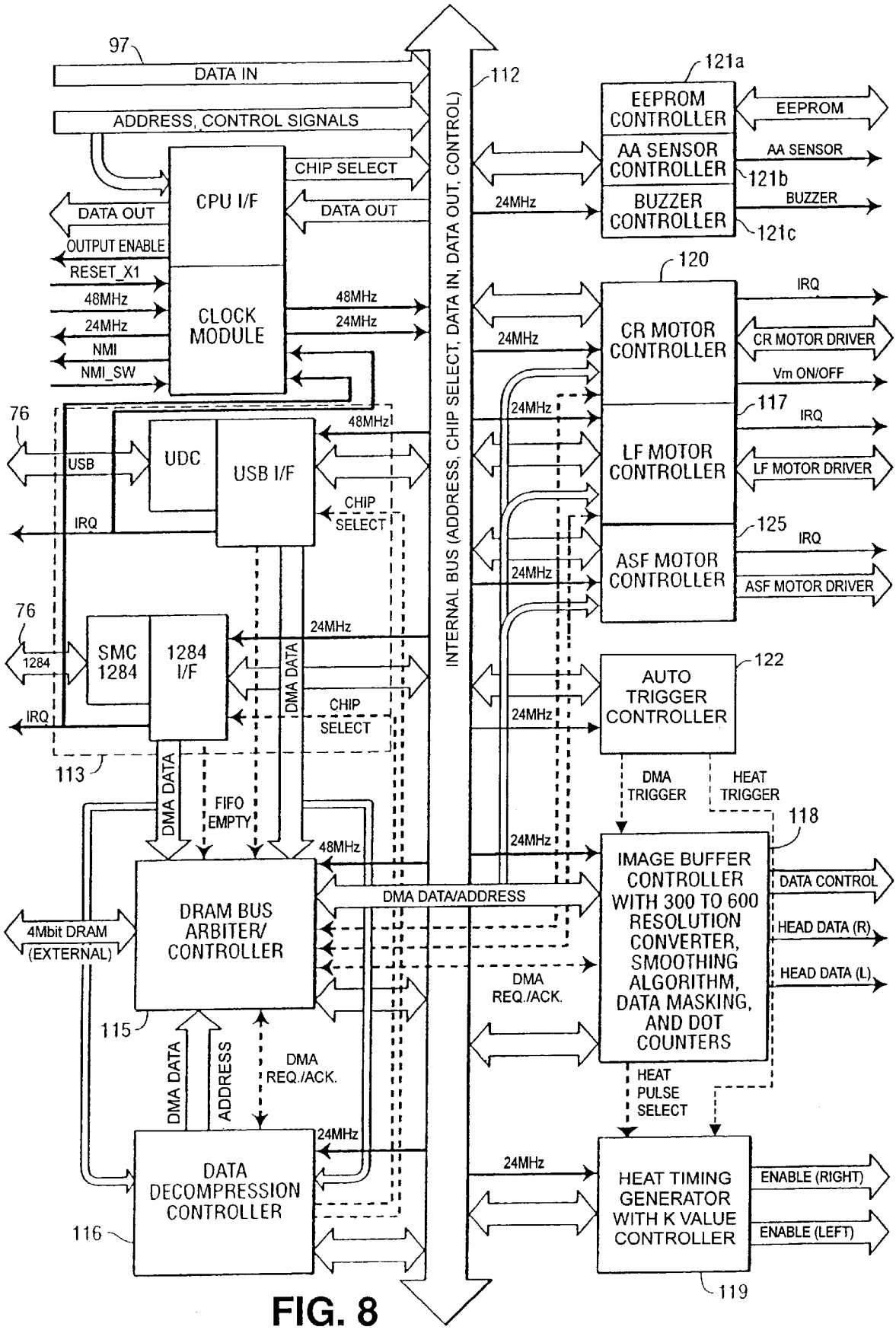
FIG. 8 is a block diagram showing the internal configuration of the gate array shown in FIG. 6.

FIG. 8 depicts a block diagram of a combined configuration for control logic 94 and I/O ports unit 96, which as mentioned above, I/O ports unit 96 may be included within control logic 94. In FIG. 8, internal bus 112 is connected to printer bus 97 for communication with printer CPU 91. Bus 112 is coupled to host computer interface 113 (shown in dashed lines), which is connected to bi-directional line 76 for carrying out bi-directional communication. As shown in FIG. 8, bi-directional line 76 may be either an IEEE-1284 line or a USB line. Bi-directional communication line 76 is also coupled to printer interface 74 of host processor 2. Host computer interface 113 includes both IEEE-1284 and USB interfaces, both of which are connected to bus 112 and to DRAM bus arbiter/controller 115 for controlling RAM 99 which includes print buffer 109 (see FIG. 7). Data decompressor 116 is connected to bus 112, DRAM bus arbiter/controller 115 and each of the IEEE-1284 and USB interfaces of host computer interface 113 to decompress print data when processing. Also coupled to bus 112 are line feed motor controller 117 that is connected to line feed motor driver 34*a* of FIG. 6, image buffer controller 118 which provides serial control signals and head data signals for each of print heads 56*a* and 56*b*, heat timing generator 119 which provides block control signals and analog heat pulses for each of print heads 56*a* and 56*b*, carriage motor controller 120 that is connected to carriage motor driver 39*a* of FIG. 6, and ASF motor controller 125 that is connected to ASF motor driver 41*a* of FIG. 6. Additionally, EEPROM controller 121*a* and automatic alignment sensor controller 121*b* are connected to bus 112 for controlling EEPROM 102 and automatic alignment sensor (generally represented within sensors 103 of FIG. 6). Further, auto trigger controller 122 is connected to bus 112 and provides signals to image buffer controller 118 and heat timing generator 119, for controlling the firing of the nozzles of print heads 56*a* and 56*b*.

Control logic 94 operates to receive commands from host processor 2 for use in CPU 91, and to send printer status and other response signals to host processor 2 through host computer interface 113 and bi-directional communication line 76. Print data and print buffer memory addresses for print data received from host processor 2 are sent to print buffer 109 in RAM 99 via DRAM bus arbiter/controller 115, and the addressed print data from print buffer 109 is transferred through controller 115 to print engine 101 for printing by print heads 56*a* and 56*b*. In this regard, heat-timing generator 119 generates analog heat pulses required for printing the print data.

Figure 9:
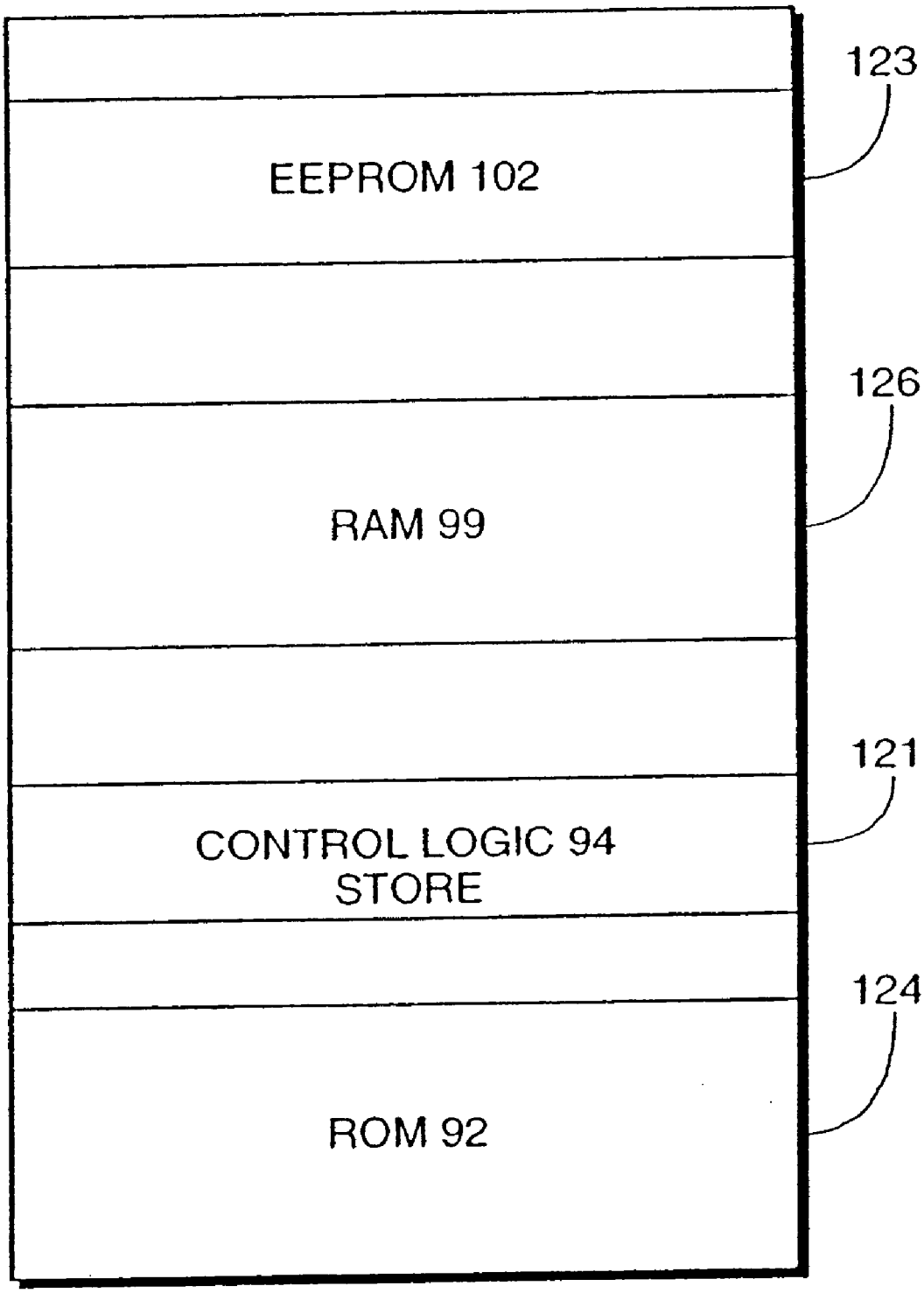
FIG. 9 shows the memory architecture of a printer according to the present invention.

FIG. 9 shows the memory architecture for printer 10. As shown in FIG. 9, EEPROM 102, RAM 99, ROM 92 and temporary storage for control logic 94 form a memory structure with a single addressing arrangement. Referring to FIG. 9, EEPROM 102, shown as non-volatile memory section 123, stores a set of parameters that are used by host processor 2 and that identify printer and print heads, print head status, print head alignment, and other print head characteristics. EEPROM 102 also stores another set of parameters, such as clean time, auto-alignment sensor data, etc., which are used by printer 10. ROM 92, shown as memory section 124, stores information for printer operation that is invariant, such as program sequences for printer tasks and print head operation temperature tables that are used to control the generation of nozzle heat pulses, etc. A random access memory section 121 stores temporary operational information for control logic 94, and memory section 126 corresponding to RAM 99 includes storage for variable operational data for printer tasks and print buffer 109.

The present invention is illustrated with reference to FIG. 10 and line feed motor 34. However any motor within a device can be used to generate the sound. For example, in addition to line feed motor 34 of printer 10, ASF motor 41 and carriage motor 39 may also be used. It is possible, for example, to selectively use one or the other of a device's motors based on whether it is currently free (i.e., not in use). Thus, for example, if line feed motor 34 is currently being used to feed paper, it may be possible to use ASF motor 41 or carriage motor 39.

As previously discussed, line feed motor 34 controls the rotation of rollers that transport media from either the automatic feeder or manual feeder through the printer to the media eject port. Line feed motor 34 is physically geared to the printer's line feed mechanism. In addition, line feed motor 34 also drives the rotary pump of ink cleaning mechanism so as to suction excess ink from a print head connected to print head connection cap.

The phase control of line feed motor 34, in addition to controlling feeding of a recording medium through the printer, can be adapted to produce an audible sound so as to replace, or supplement, the current piezoelectric, or other type of, buzzer. In normal operation of a motor such as line feed motor 34, there is a "gradual ramp up" so that the motor's acceleration may be matched with the motor's torque capability. However, it was observed by the present inventors that when an "instantaneous" rate of acceleration occurs, the stepper motor loses control and "slips". As a result, a sound, or noise, occurs which is unlike any sound ordinarily generated during normal operation of the motor. The present invention determines an operation sequence for controlling the operation of a motor so as to cause the instantaneous acceleration thereby causing the generation of an audible sound. In a case that the motor is used for multiple operations (e.g., use of motor 34 for both line feed and notification operations), the operation sequence of the motor that produces the audible sound is different from the normal operation sequence used to perform the line feed operation, and the notification function's operation sequence is such that the normal function of the motor is not impacted. For example, line feed motor 34 performs the notification function only and the notification function does not result in advancing the recording medium. Further, the sound that the motor makes under normal operations is different than the sound made under notification operation.

Movement of the motor according to the present invention causes the motor to vibrate and it is the resulting vibration that produces the sound. A motor that is controlled to generate the audible sound according to the present invention moves, or rotates about an axis, in a first direction for "n" motor steps and in a reverse direction for "m" motor steps, where "m" is equal to "n" and the motor is controlled to return to an original location that existed prior to the initiation of the notification operation.

Figure 12A:
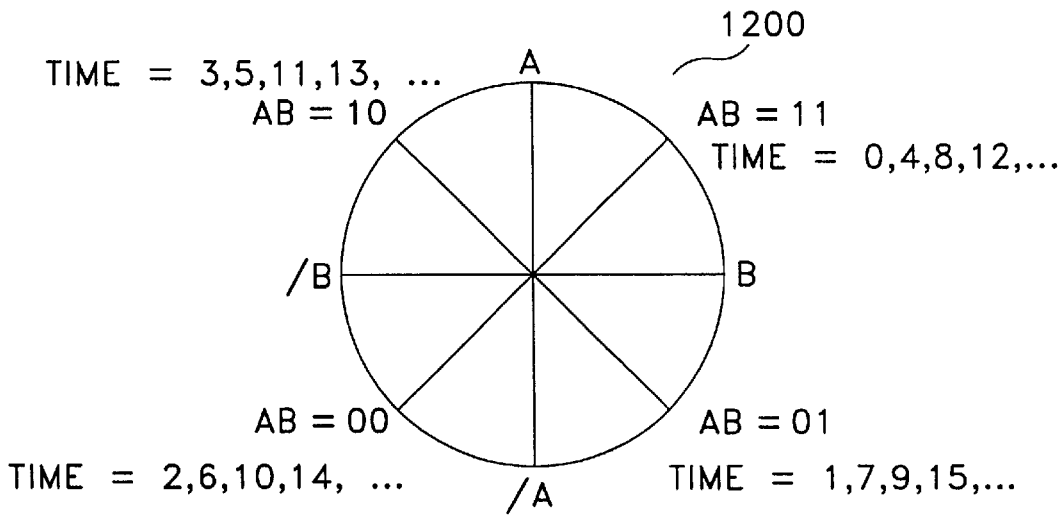
FIG. 12A is a drawing illustrating the motor phase control according to the present invention.
Figure 12B:
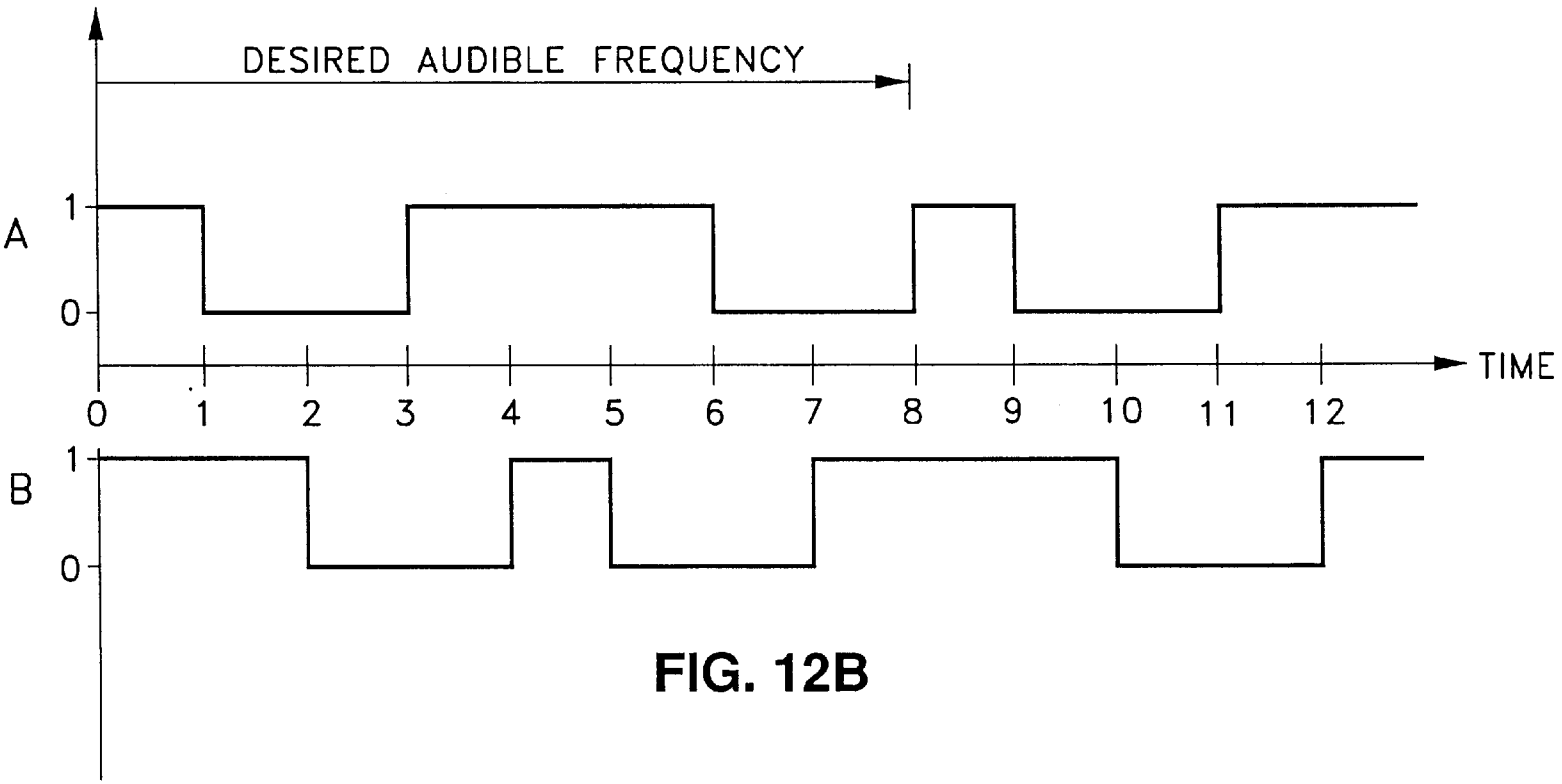
FIG. 12B is a diagram illustrating the timing corresponding to the motor phase control of FIG. 12A.

As mentioned above, line feed motor 34 is physically geared to the printer's line feed mechanism. In order to minimize or eliminate motor rotation that could result in undesired mechanical motion (e.g., a change in position of the recording medium in the case of line feed motor 34) and noise due to such motion of the line feed mechanism as a result of instantaneously pulsing the motor, motor phase control consists of moving the motor 360 phase degrees forward, 360 phase degrees backward, and then repeating the forward and backward rotation as needed. FIG. 12A shows the motor phase stepping sequence performed to move the motor in a forward and backward motion, while FIG. 12B depicts the timing corresponding to the stepping sequence of FIG. 12A.

Referring to FIG. 12A, in motor phase diagram 1200, diagonal positions represent the two phase positions. For example, a diagonal exists between positions "AB=11" and "AB=00". For the sake of illustration, the motor is considered to be stopped, or at an original or starting position, at position "AB=11". Table 1201 illustrates operation sequence of a motor such as motor 34 at various times in a notification operation. FIG. 12B provides a timing diagram that corresponds to the phase control example of Table 1201. At motor step 1 and time 0 in table 1201, the motor is controlled so as to cause it to be in position "AB=11", which is the starting position for the operation sequence. At motor step 2 and time 1, instruction is provided to the motor to cause it to change position, or rotate, from "AB=11" to "AB=01". The direction of the movement is clockwise (or "CW"). The motor continues to move in the clockwise direction with motor steps 3 and 5, at times 2 to 4, respectively. At time 5, motor step 6, the motor changes position from "AB=11" to "AB=10". As a result, the motor changes direction without first being stopped, or slowed, in anticipation of the change in direction. It is the change of direction that causes the motor to vibrate and produce an audible sound.

In Table 1201, the motor continues generating an audible sound by reversing direction again at motor step 10 and time 9. At this time, the motor changes positions from "AB=11" to "AB=01" and changes direction from counterclockwise to clockwise. It should be apparent that motor step 9 corresponds to motor step 1, and that the sequence can be repeated any number of times to continue generating an audible sound.

Figure 12C:
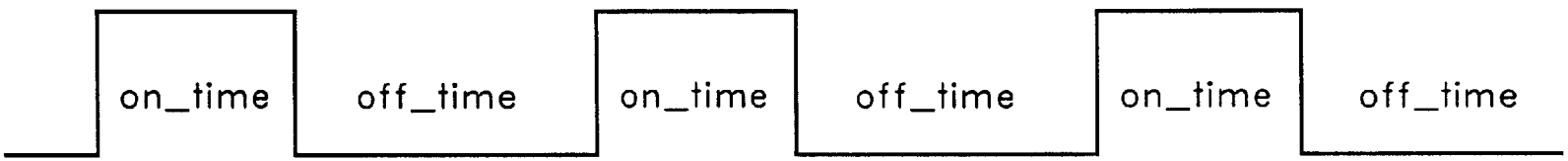
FIG. 12C is a drawing illustrating alternating periods of motor excitation and no motor excitation according to the present invention.

Sound generation may be terminated or paused, however. Referring to FIG. 12C, an operation sequence is illustrated whereby the motor generates sound during the "on_time" and does not generate sound during a "pause" or an "off_time". In the example of Table 1202, motor steps 1 through 8 are performed during the on_time as described above with reference to Table 1201. During an off_time the motor is paused at a position, preferably the starting position. Table 1202 provides an example of a pause in sound generation. According to the present invention, the motor is returned to its starting position so that normal (e.g., line feed) operations may resume at that point. Therefore, since in the two-phase motor example of FIG. 12A, the sequence of eight steps positions the motor at position "AB=01". In order to return the motor to its original position, the motor is stepped once more in the counterclockwise position with motor step 9, at time 8. Instead of changing direction at motor step 10 as in Table 1201, in Table 1202, the operation sequence pauses during an off_time by instructing the motor to remain in position "AB=11" for a number of motor steps to achieve the desired pause duration. Once the desired pause duration has been achieved, an on_time operation sequence may be initiated (e.g., as in motor steps 1 to 8).

Therefore, to produce a continuous sound, a 360-phase degree forward and 360-phase degree backward motion, or rotation, is continuously repeated with no perceptibly noticeable interval(s) between them. In order to produce a series of consecutive beeps, on_time periods of motor excitation, as described above, are alternated with off_time periods as depicted in FIG. 12C.

Any motor that is currently not being used for another purpose may be used to generate an audible sound according to the present invention. For example, as indicated above, whenever line feed motor 34 is not in normal use (i.e., feeding recording medium through the printer), it may be used to generate an alarm.

Figure 11A:
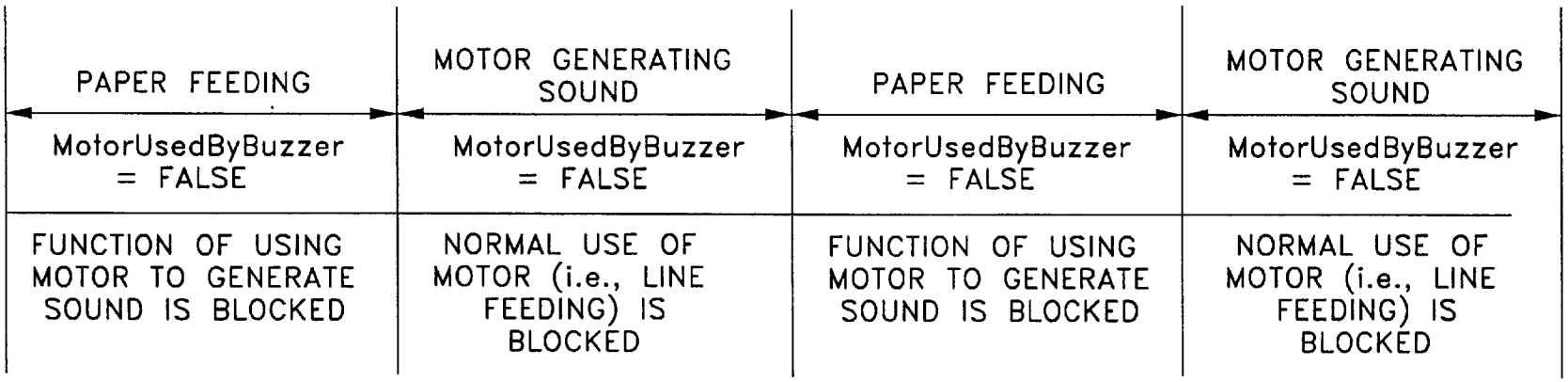
FIGS. 11A and 11B are drawings illustrating timing relationships between operating the motor during normal use and for generating an audible sound according to the present invention.

A flag, referred to as the MotorUsedByBuzzer flag, is set to indicate whether motor 34 is currently being used for its paper feeding function or is being used to generate a sound. As shown in FIG. 11A, when paper is being fed through the printer, the MotorUsedByBuzzer flag is set to FALSE, which prevents motor 34 from being used to generate sound. Once the paper feeding process has completed, the MotorUsedByBuzzer flag may be set to TRUE, and motor 34 may then be used to generate sound. When MotorUsedByBuzzer is set to TRUE, motor's 34 paper feeding function is blocked.

Figure 11B:
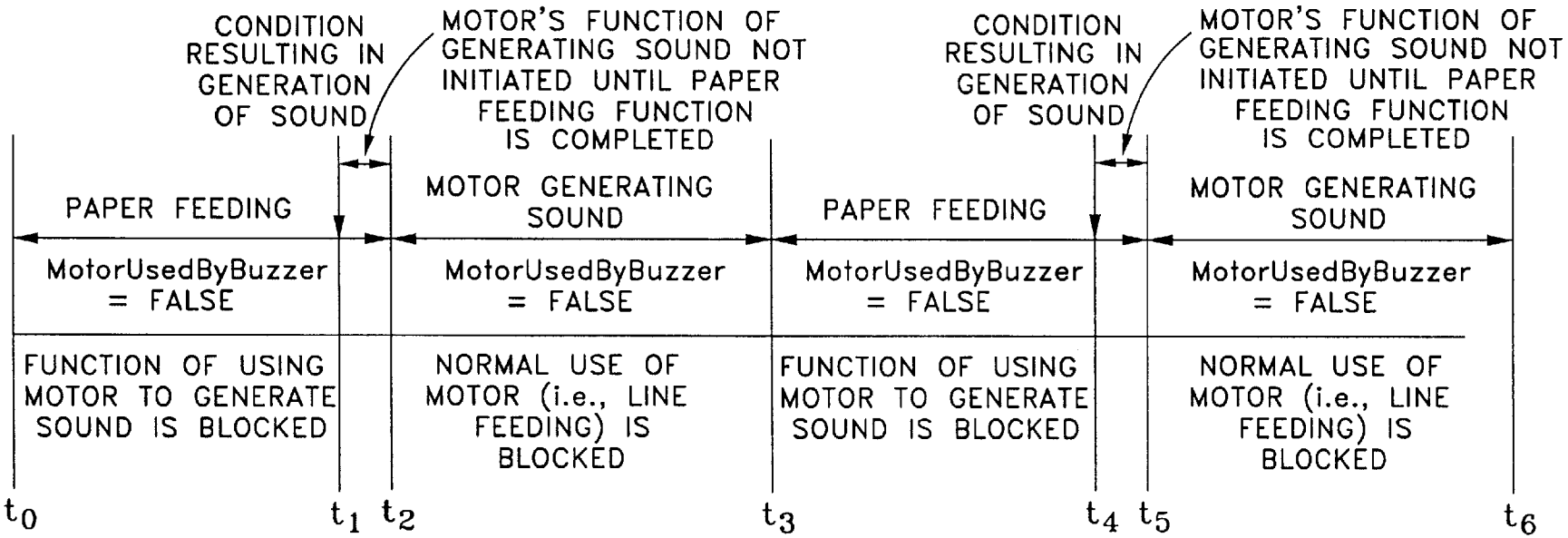

FIG. 11B depicts the situation where a condition resulting in generation of sound occurs while feeding paper through the printer, the function of generating sound is initiated once the paper feeding function has completed. In the example of FIG. 11B, the MotorUsedByBuzzer flag is equal to FALSE during the period from t0 to t2 while paper is being fed. At time t1, a condition (e.g., a recoverable error) occurs and a sound is to be generated to notify of the condition. However, time t1 occurs during the period from t0 to t2 while paper is being fed. At time t2, once the paper feeding function is complete, the MotorUsedByBuzzer flag is set to TRUE and the sound is generated to notify of the condition that occurred at time t1.

Once the sound is generated, the MotorUsedByBuzzer flag may be set to FALSE thereby allowing a paper feeding function to occur. For example, at time t3, the MotorUsedByBuzzer flag is set to FALSE, and a paper feeding function may be performed. If another alarm condition occurs at time t4, the MotorUsedByBuzzer is set to TRUE, once the paper feeding function completes, at time t5, and the alarm is generated. Once the appropriate sound is generated, the MotorUsedByBuzzer flag is set to FALSE at time t6.

Figure 10A:
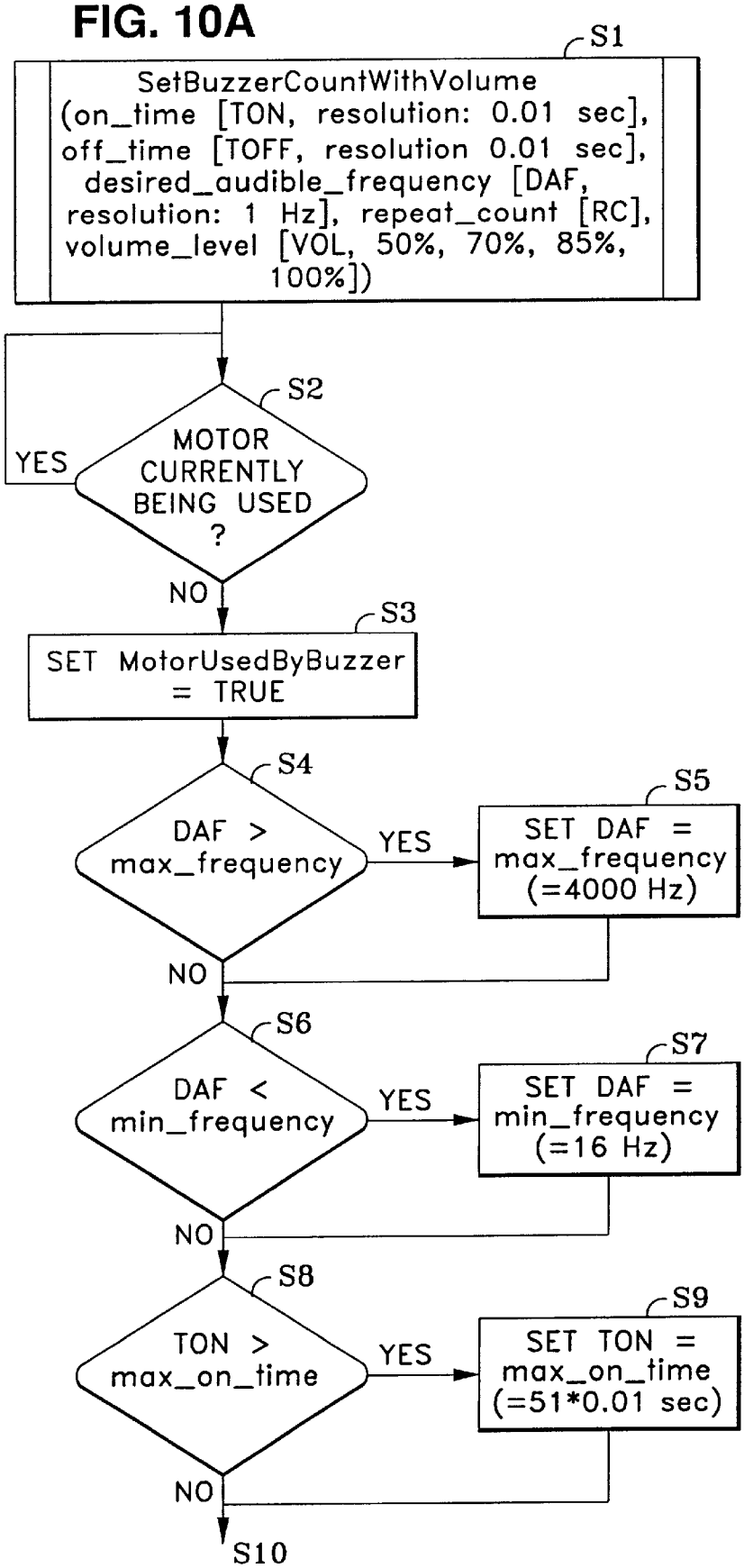
FIGS. 10A to 10D is a drawing illustrating the sequence of steps preferably executed for creating an audible sound using a motor according to the present invention.
Figure 10:
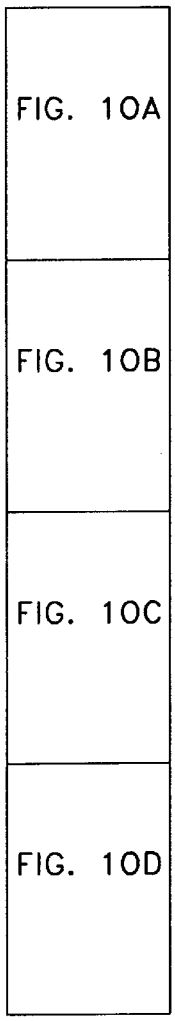
FIG. 10, which comprises
Figure 10B:
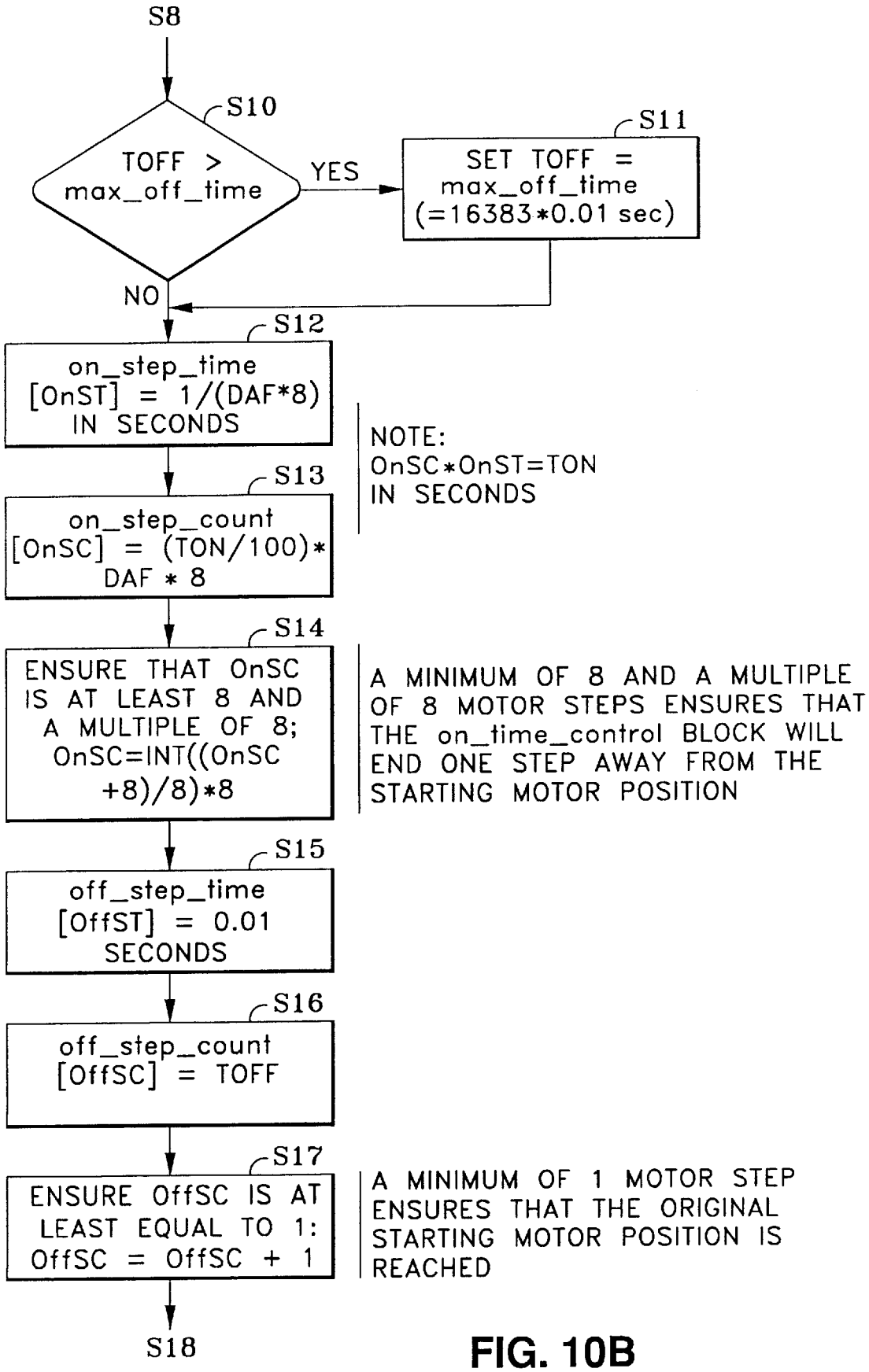
Figure 10C:
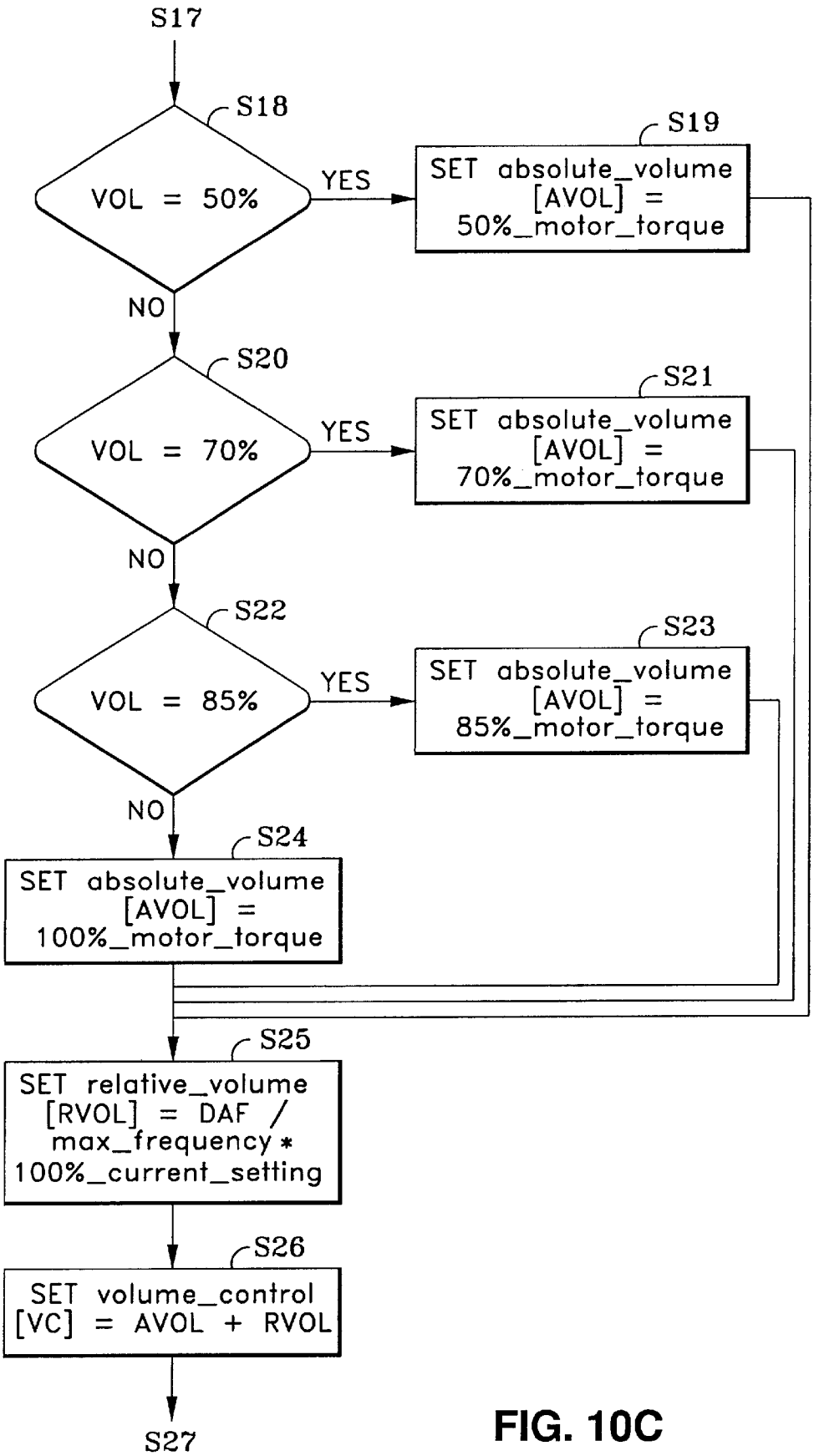
Figure 10D:
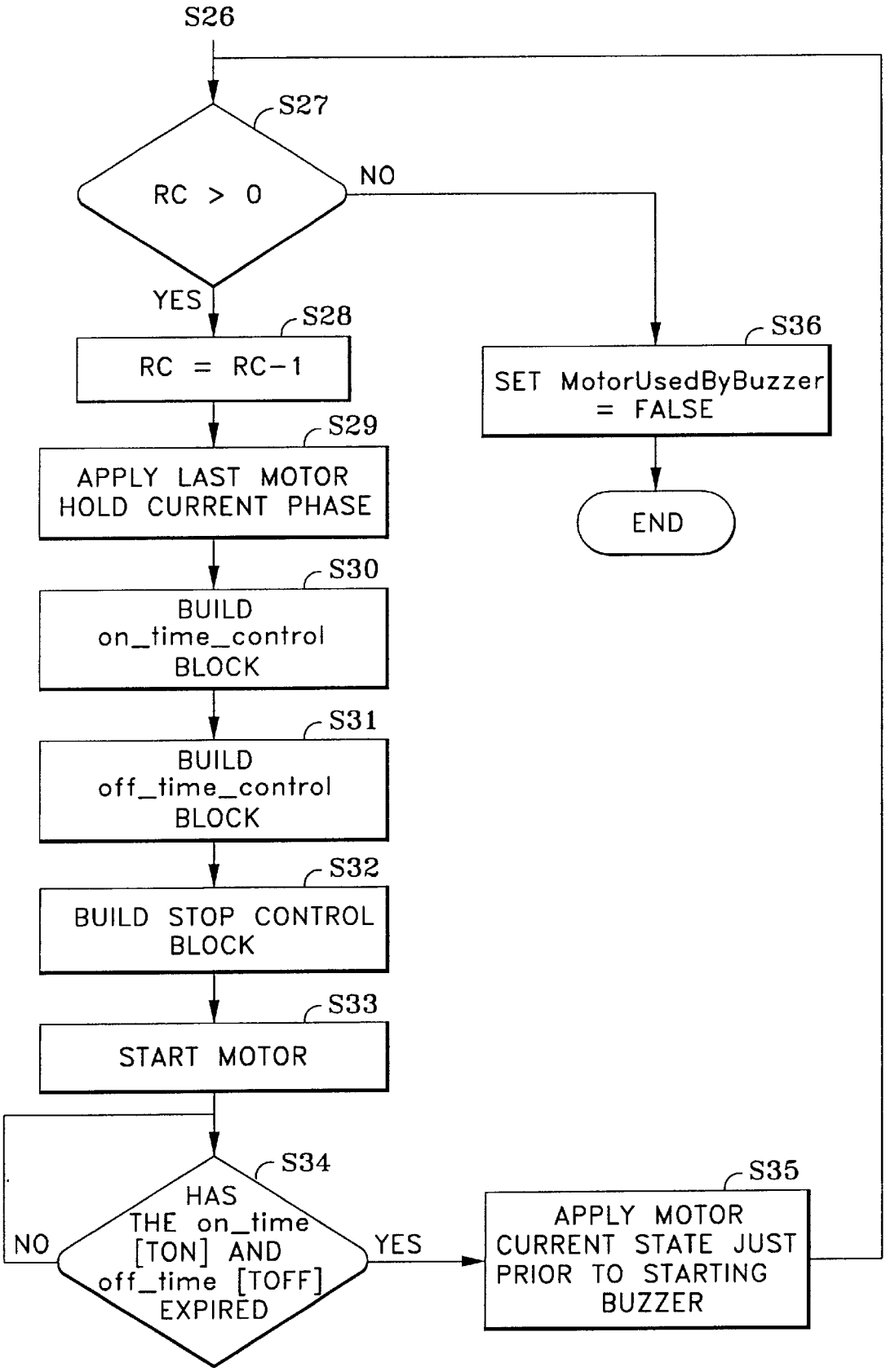

Use of the MotorUsedByBuzzer flag is further described in FIG. 10 which provides a more detailed description of generating an audible sound using a motor of an ink jet printer according to the invention. As stated above, any motor within the printer can be used to generate the sound. In fact, while FIG. 10 uses line feed motor 34, it is possible to use any of the printer's motors. It should be understood that the invention could be practiced using another motor, such as the carriage motor 39 or the automatic sheet load motor 41. Further, although it is not shown in FIG. 10, it is possible to use multiple motors, so that a sound may be generated by one motor that is currently not being used for its normal function while another is currently being used for its normal function. That is, a determination may be made as to which if any motor is not being used, and then using one of the idle motors to generate an audible sound.

FIG. 10 is a flow chart depicting a sequence of steps that are preferably executed within the printer for commanding the printer to create an audible sound using a motor. Briefly, an initial determination is made whether the motor is in the process of performing another task (i.e., as indicated by the MotorUsedByBuzzer flag). If it is not, it is available for use in generating an audible sound. If it is available, control blocks are generated for use in controlling the motor to generate the audible sound. The control blocks include indications of the number of motor steps and time used for each step for both the on_time and off_time periods. These control blocks are provided to an ASIC to set a motor driver IC control word corresponding to each motor step, which is supplied to a motor driver IC of the motor. The control blocks determine the rate at which a control word is sent to the motor's driver based on a desired audible frequency (DAF) so as to drive the motor to generate the desired sound.

Based on the information supplied in the control blocks, the DAF and volume information, an audible sound is generated by the motor. By varying this information, it is possible to generate audible sounds that differ with respect to duration, frequency and volume of the sound. In so doing, it is possible to generate different sounds for different conditions.

Referring to FIG. 10, in step S1, a SetBuzzerCountWithVolume command initiates the procedure for using the motor to generate an audible sound. The command is generated in response to detection of a condition for which a sound is generated as notification of the condition. The command is used to specify various values that are used in generating a sound. The command includes on_time, off_time, DAF, repeat count, and volume level parameters for which values are provided as part of the command. The on_time and off_time parameters specify a duration and correspond to the on_time and off_time periods shown in FIG. 12C. As discussed above, the DAF represents the desired frequency of the generated sound. The repeat count parameter is the number of times an on_time/off_time set is performed, and the volume level parameter is the volume of the generated sound. A resolution is also included for the on_time, off_time and DAF parameters that represents a resolution for the unit of measure used for these parameters. For example, an on_time parameter value may be expressed in one-hundredths of one second.

FIG. 14 depicts examples of conditions for which a sound, or alarm, is generated and their respective parameter values. The list includes conditions for which a user response is possible (i.e., a recoverable error) as well as error conditions. The on_time, off_time, repeat count and DAF parameters are different for the two categories of conditions to differentiate between user response and error conditions. It is also possible to vary parameters within a category to further differentiate between conditions within a category of conditions.

To further illustrate, in the first category, an on_time duration of 100 milliseconds is set with a DAF of 1046 Hz and a 100% volume. The repeat count is set to "1" and indicates that the sound generation is performed once. Thus, there is no value assigned to off_time to indicate the time in between intervals of motor excitation. In the second category, "FatalError" has a repeat count of "7". The period of motor excitation, or on_time of 50 milliseconds and off_time of duration 20 milliseconds. The FatalError condition's DAF is 1244 Hz and the volume is 100%.

Referring again to FIG. 10, at step S2, a check is made to determine whether the motor used to generate the sound is currently being used for an other function based on the MotorUsedByBuzzer flag. For example, in a case of line feed motor 34, a determination is made whether line feed motor 34 is currently feeding paper. If line feed motor 34 is not being used for normal functioning, the MotorUsedBy-Buzzer flag is set, in step S3, to TRUE to indicate that line feed motor 34 is being used to generate a sound. By setting the MotorUsedByBuzzer flag to TRUE, normal functioning of line feed motor 34 is locked out. If it is determined, at step S3, that the motor is being used for a function other than generating a sound according to the present invention, the process cycles until the motor becomes free.

Preferably, maximum and minimum values are associated with the DAF parameter value and a maximum value is associated with each of the on_time and off_time parameters. At steps S4 and S6, a determination is made whether the DAF is within an acceptable range set by the maximum and minimum DAF values. If not, DAF is set to within the acceptable range. For example, if the DAF parameter exceeds the maximum DAF value, the DAF parameter is set to the maximum DAF value in step S5. Similarly, if the DAF parameter value is less than the minimum DAF value, the DAF parameter value is set to the minimum DAF value in step S7.

At steps S8 and S10, the on_time and off_time parameter values (referred to as "TON" and "TOFF", respectively) are examined to ensure that the values do not exceed their corresponding threshold maximum values. If the on_time parameter value exceeds its maximum on_time threshold value (e.g., "51"), step S9 is performed to set the on_time parameter to the threshold maximum amount multiplied by the on_time resolution (e.g., 0.01 seconds). At step S11, the off_time parameter is adjusted based on the maximum off_time threshold amount (e.g., 16,383) multiplied by the off_time resolution (e.g., 0.01 seconds). The values determined in steps S5, S7, S9, and S11 represent the nominal DAF maximum frequency (e.g., 4000 Hz), nominal DAF minimum frequency (e.g., 16 Hz), nominal maximum on_time (e.g., 51*0.01 sec.), and nominal maximum off_time (e.g., 16383*0.01 sec.), respectively.

Flow then proceeds to step S12, wherein the time in seconds between motor steps is determined. As discussed above, the number of steps is determined so that the motor is returned to its starting position within the specified desired audible frequency. In this example, the motor is rotated eight steps, four in the forward direction and four in the reverse direction. By using eight, or a multiple thereof, of steps, the process will end one step away from the starting position of the motor.

Steps S12 to S14 determine the number of steps to be performed during an on_time which is a multiple of eight. This value is represented by "on_step_count" (or "OnSC"). The variable "on_step_time" (or "OnST") which represents the time for each step, is calculated based on the DAF using eight steps.

More particularly, step S12 determines OnST to be one-eighth of the total period associated with the DAF. In other words, OnST is equal to one-eighth of one over DAF. The number of steps, i.e., OnSC, is determined to be the total on_time, TON (converted to the desired resolution), divided by OnST. OnSC is determined at step S13.

Step S14 ensures that no less than and some multiple of eight motor steps is performed during the on_time. As discussed above, this is done so that at the end of the on_time period, the motor will be positioned one step away from its initial starting position.

While steps S12 and S13 calculate the information associated with a motor in the on_time period using the on_time and DAF parameters, steps S15 and S16 calculate information associated with the off_time. Each step in the off_time is set to a constant of 0.01 seconds in step S15. In step S16, the number of motor steps during the off_time is set equal to the off_time value. A minimum of one motor step ensures that the original starting motor position is reached. That is, after the on_time duration has elapsed, it is necessary to make sure that the motor is moved back to the same position it started from. Thus, step S17 ensures that OffSC is set to at least one.

As discussed above, the torque created by operating the motor as described herein causes the motor to create the audible sound used in the notification operation. Different levels of torque may be used to vary the volume of the audible sound created by the motor. Preferably, four torque levels, 50%, 70%, 85%, and 100%, are used each corresponding to an "absolute" volume level. Steps S18, S20, and S22 examine the volume level parameter to determine whether it is set to 50%, 70%, or 85% respectively. If the volume level parameter is set to any of these three values, then the absolute volume level is set to the corresponding motor torque value in steps S19, S21, or S23 respectively.

Where the initial volume level is not equal to 50%, 70%, or 85%, the absolute volume is set to 100% of motor torque in step S24.

In order to provide finer control of the sound volume, each absolute volume level has its own series of "relative" sound levels, which provide a finer calibration of the volume level and directly affect the final torque level. There are 16 relative volume levels for each absolute sound level, ranging from 0% to 100%. Once an absolute sound level is established, a relative sound level is calculated in step S25. The relative volume level is the DAF divided by the result of the maximum frequency multiplied by 100% of the current setting. It can be used to create different volume levels corresponding to the circumstances of an event, such as a time of day in which the event occurs (e.g., one volume may be used during the day and another at night), for example. Volume control is then set in step S26 by adding the absolute volume level and its corresponding relative volume level.

Before the motor is commanded to generate a sound, a check of the Repeat Count variable is made to examine the repeat count value as shown in step S27. If Repeat Count in step S27 is zero, no more sounds are to be generated. Processing continues at step S36 to set the MotorUsedBy-Buzzer flag to FALSE, indicating that the motor is free to be used for other functions, i.e., feeding the recording paper through the printer.

If Repeat Count is greater than zero, flow proceeds to step S28, where Repeat Count is decremented by one. Step S29 positions the motor to begin the audible sound generation (or notification) operation sequence. Initially, the motor is positioned to ensure that it is at its last holding position. It is possible that the motor's phases have both been turned "OFF" prior to the sound generation (or notification) operation. The set up operation performed in step S29 re-energizes the motor's coils to the last holding position thereby setting the initial motor state before the notification operation sequence is intiated.

In steps S30, S31, and S32, an on_time control block, off_time control block, and stop control blocks are constructed in printer's 10 DRAM as shown in FIG. 12D. As indicated above, printer's 10 ASIC uses these control blocks to set the motor driver IC control word, illustrated in FIG. 12E.

Referring to FIG. 12D, the on_time control block includes the information used to build a control word for the on_time period. The off_time control block includes information used to build a control word for the off_time period. The stop control block acts as an "end of information" marker so the ASIC does not continue reading DRAM for control information.

The on_time control block identifies the number of motor steps (i.e., on_step_count) to be performed for an on_time period. The ASIC cycles through each of the motor step entries and constructs a control word for each entry. The on_step_time is used by the ASIC to determine the timing for sending a control word to the motor driver IC. As discussed above, the on_step_time is determined based on the DAF. The motor is thereby driven at a rate determined by the DAF to generate the desired sound per as described above.

Similarly, the ASIC uses the off_time control block to generate one or more control words during an off_time period. The off_step_count identifies the number of steps for which the ASIC constructs control words. The ASIC cycles through each of the motor step entries in the off_time control block and constructs a control word for each entry. The off_step_time is used by the ASIC to determine timing for sending a control word to the motor driver.

FIG. 12E provides an example of a motor driver IC control word format. Obviously, the actual format of a motor driver IC control word will depend on the motor driver IC chip used. In this example, Phase A sets the current direction through coil A and Phase B sets the current direction through coil B. Fields IA3 to IA0 and IB3 to IB0 designate the current magnitude (one of sixteen levels), respectively. Fields decay A1 and decay A0 set the rate of decay for coil A while decay B1 and decay B0 set the rate of decay for coil B. In addition, the control word specifies the torque levels T1 and T0.

In step S34, a determination is made whether the on_time and off_time durations have expired. If they have not, processing waits until the times have expired before applying, in step S35, the motor current state just prior to using the motor to generate the sound. In so doing, it is ensured that the motor is returned to the position that it was in prior to starting the notification operation. That is, the motor's state is re-set to the position it was in just prior to entering the routine of FIG. 10 so that when the motor is no longer used to generate sound, its position will have been restored to its original state. And processing continues at step S27 to determine whether to continue generating an audible sound based on the repeat count value.

As previously discussed, the motor used in a notification operation sequence may be used to perform any other function, or functions. In the case of line feed motor 34, the motor is used to advance a recording medium and may be used to generate a notification. FIGS. 13A and 13B illustrate the difference in motor phases when the motor is used to generate sound and when it is used to feed paper.

Referring to FIG. 13A, which illustrates the motor phases in a notification operation sequence, phases A and B are set such that the motor reverses direction at time 5 and again at time 9. In FIG. 13B, which illustrates the motor phases in a line feed operation, phases A and B are set so that the motor moves in one direction during the operation (e.g., a line feed operation) in order to advance the recording medium. In addition, as indicated in FIG. 13A, the notification operation causes phases A and B to return to an original state (e.g., at time 9) so that line feed motor 34 performs only the notification operation and does not result in a change in the line feed. It can be said that the two operations are therefore exclusive, such that the notification operation performs only the function of notification without impacting the line feed function of line feed motor 34.

The invention has been described with respect to particular illustrative embodiments. However, it is to be understood that the invention is not limited to the above-described embodiments and that various changes and modifications may be made by those of ordinary skill in the art without departing from the spirit and scope of the invention.

What is claimed is:

1. A method for generating an audible sound in an imaging device, the device having an electronic motor controllable by a first operation sequence to perform a first function, the method comprising the steps of:

detecting a condition for which an audible sound is to be generated as notification of the condition; and causing the motor to rotate according to a second operation sequence so as to create the audible sound as notification of the condition, wherein the second operation sequence causes the motor to rotate in a manner, other than the motor rotation resulting from the first operation sequence, so as to cause the motor to perform only the notification function.

2. A method according to claim 1, wherein the second operation sequence causes the motor to rotate in a first direction then rotate in a second direction opposite to said first direction, wherein said rotation in a first and second direction is repeated for a predetermined time.

3. A method according to claim 2, wherein said first direction is a forward direction.

4. A method according to claim 2, wherein said second direction is a reverse direction.

5. A method according to claim 2, wherein the motor is a two-phase electric motor, and the operation sequence comprises a plurality of steps.

6. A method according to claim 5, wherein the motor is rotated from an original position in the first direction for n steps and then in the opposite direction for n steps to return the motor to the original position.

7. A method according to claim 1, wherein said device is an image-recording device.

8. A method according to claim 7, wherein said motor is a line feed motor and the first function of the line feed motor comprises advancement of a recording medium in the image-recording device.

9. A method according to claim 7, wherein said motor is a carriage control motor and the first function of the carriage control motor comprises movement of a recording carriage in the image-recording device.

10. A method according to claim 7, wherein said motor is an automatic sheet feed motor and the first function of the automatic sheet feed motor comprises feeding a recording medium into the image-recording device.

11. A method according to claim 1, wherein a volume of said audible sound is varied according to an amount of torque caused by the second operating sequence.

12. A method according to claim 1, wherein a duration of said audible sound is based at least in part on a desired audible frequency of the audible sound.

13. A method according to claim 1, wherein upon completion of the notification function, the motor is returned to a position for performing either the first function or the notification function.

14. An apparatus for generating an audible sound in an imaging device, the device having an electronic motor controllable by a first operation sequence to perform a first function, said apparatus comprising means for performing the functions specified in any of claims 1 to 13.

15. An apparatus for generating an audible sound in an imaging device, the device having an electronic motor controllable by a first operation sequence to perform a first function, comprising:

a program memory for storing process steps executable to perform a method according to any of claims 1 to 13; and a processor for executing the process steps stored in said program memory.

16. Computer-executable process steps stored on a computer readable medium, said computer-executable process steps for generating an audible sound in an imaging device, the device having an electronic motor controllable by a first operation sequence to perform a first function, said computer-executable process steps comprising process steps executable to perform a method according to any of claims 1 to 13.

* * * * *